US009500424B1

(12) United States Patent
Lodewyks

(10) Patent No.: US 9,500,424 B1
(45) Date of Patent: Nov. 22, 2016

(54) EXTRACTOR AND RELATED BARREL AND BARREL ADAPTOR

(71) Applicant: Ronald J. Lodewyks, Caledonia (CA)

(72) Inventor: Ronald J. Lodewyks, Caledonia (CA)

( * ) Notice: Subject to any disclaimer, the term of this patent is extended or adjusted under 35 U.S.C. 154(b) by 0 days.

(21) Appl. No.: 14/821,671

(22) Filed: Aug. 7, 2015

(51) Int. Cl.

| | |
|---|---|
| ***F41A 15/06*** | (2006.01) |
| *F41A 15/10* | (2006.01) |
| *F41A 15/08* | (2006.01) |
| *F41A 15/00* | (2006.01) |

(52) U.S. Cl.
CPC ..... *F41A 15/06* (2013.01); *F41A 15/00* (2013.01); *F41A 15/08* (2013.01); *F41A 15/10* (2013.01)

(58) Field of Classification Search
CPC ..... F41A 15/06; F41A 15/00; F41A 15/08; F41A 15/10; F41A 15/18
USPC ..... 42/8, 40, 41, 42.01, 42.02, 42.03, 42/43–48, 75.04
See application file for complete search history.

(56) References Cited

U.S. PATENT DOCUMENTS

| | | | | |
|---|---|---|---|---|
| 230,224 | A | 7/1880 | Beebe | |
| 261,663 | A * | 7/1882 | Brown | F41A 15/06 42/46 |
| 2,603,019 | A | 7/1952 | Elkas | |
| 2,603,020 | A | 7/1952 | Hussey | |
| 2,982,044 | A * | 5/1961 | Sefried, II | F41A 15/06 42/47 |
| 3,161,978 | A | 12/1964 | O'Brien et al. | |
| 3,477,162 | A | 11/1969 | Morse | |
| 4,442,619 | A | 4/1984 | McCarley | |
| 4,646,458 | A | 3/1987 | Stevens | |
| 4,676,017 | A | 6/1987 | Hurlemann et al. | |
| 4,964,232 | A | 10/1990 | Mainland et al. | |
| 5,018,293 | A | 5/1991 | Mainland | |
| 6,145,232 | A | 11/2000 | Bevins | |
| 6,397,505 | B1 | 6/2002 | Stratton et al. | |
| 7,971,380 | B1 * | 7/2011 | Gussalli Beretta | F41A 15/06 42/46 |
| 8,495,831 | B1 | 7/2013 | Kohout | |
| 2006/0248770 | A1 * | 11/2006 | Moller | F41A 15/06 42/46 |
| 2011/0072704 | A1 * | 3/2011 | Teach, Jr. | F41A 3/58 42/8 |

OTHER PUBLICATIONS

NPL: http://www.dandtcustomgunworks.websitetoolbox.com/post/contender-barrel-stubs-6342190?mobile_version=1 May 13, 2013.*
Thompson /Center Arms Co., Inc., Contender Owner's Manual for Rifle and Pistol Models, 2003.
Lowell Kenney, The Eagle View Arms Model C-Tb Barrel Stub Kit, 2012.

* cited by examiner

*Primary Examiner* — John D Cooper
(74) *Attorney, Agent, or Firm* — Steven M. Greenberg; CRGO Law

(57) ABSTRACT

A barrel adaptor for a single-shot break-action firearm comprises a barrel stub and an extractor. The barrel stub comprises a main body and a mounting lug. A barrel-receiving bore extends through the main body and can threadedly receive a barrel. Opposed parallel extractor channels are formed between the barrel-receiving bore and the locking bolt receptacle, substantially parallel to the barrel-receiving bore. An extractor head recess at the breech end of the main body extends into the barrel-receiving bore and into the lug, merging with the extractor channels to form an extractor receptacle. The extractor comprises an extractor head having an arcuate cartridge-engaging lip and opposed, spaced apart substantially parallel extractor arms received in the extractor channels. The extractor is longitudinally movable between a firing configuration where the extractor head is in the extractor head recess and an extended configuration where the extractor head is withdrawn from the extractor head recess.

12 Claims, 17 Drawing Sheets

EXTRACTOR AND RELATED BARREL AND BARREL ADAPTOR

TECHNICAL FIELD

The present disclosure relates to firearms, and more particularly to extractors for firearms and to related barrels and barrel adaptors.

BACKGROUND

Thompson/Center Arms, having an address at 2100 Roosevelt Ave., Springfield, Mass. 01104, manufactures a variety of single-shot, break-action firearms which allow for barrel assemblies chambered for different types of ammunition to be mounted onto a common receiver assembly. By interchanging the barrel assemblies, different types of ammunition can be fired using the same receiver assembly. Thompson/Center Arms offers single-shot, break-action firearms of this type under various trademarks, including the original Contender® trademark and the Encore® trademark. These types of firearms are referred to herein as "Contender-style firearms" for ease of reference, and correspondingly the receiver assemblies are referred to as "Contender-style receiver assemblies" and the barrel assemblies are referred to as "Contender-style barrel assemblies". This is merely for convenience of reference, and is not intended to limit any aspect of the present disclosure to products manufactured by Thompson/Center Arms.

The conventional extractor for Contender-style firearms generally takes the form of a longitudinally extending bar of rectangular cross-section having a notch in its inferior surface and which tapers (between the inferior and superior surfaces) from the discharge end to the breech end (the end having the extractor head). The extractor is received in a generally rectangular tunnel-like passage formed in the barrel body between the bore and the locking bolt receptacle in the lug. The tapered shape of the extractor allows the extractor to rock within the passage, enabling the extractor head to pivot toward and away from the chamber for loading and unloading cartridges. A leaf spring is interposed between the passage and the inferior surface of the extractor, adjacent the breech end thereof, to bias the extractor head toward the chamber, and a notch engages a spring pin to retain the extractor in the body.

Eagle View Arms, a division of Eagle View Research Center, LLC having an address at 130 SE Kodiak Ridge Road, Shelton, Wash. 98584 offers an internally threaded "barrel stub" into which a barrel can be threaded tightly in place to form a Contender-style barrel assembly. This offering includes an extractor, which is of generally circular cross-section at its discharge end and which narrows considerably in thickness (between the inferior and superior surfaces) from the discharge end to the breech. The narrow portion of the extractor functions as an integral leaf spring that enables the extractor head to pivot toward and away from the chamber while biasing the extractor head toward the chamber.

SUMMARY

In one aspect, the present disclosure describes a barrel adaptor for a single-shot break-action firearm. The barrel adaptor comprises a barrel stub comprising a main body and a lug. The main body has a breech end and a discharge end and a barrel-receiving bore extending therethrough from the breech end to the discharge end. The barrel-receiving bore comprises an internally threaded portion extending from the discharge end toward the breech end. The lug protrudes from the main body adjacent the breech end, and is adapted for mounting to a single-shot break-action firearm receiver assembly. A crossbore extends through the lug substantially perpendicularly to the barrel-receiving bore and is adapted to receive a hinge pin. The crossbore is disposed at a first end of the lug distal from the breech end. A locking bolt receptacle is formed in the lug and is adapted to receive a locking bolt and a locking bolt spring. The locking bolt receptacle is disposed at a second end of the lug proximal to the breech end. A pair of opposed parallel extractor channels is formed in the barrel stub between the barrel-receiving bore and the locking bolt receptacle. The extractor channels are substantially parallel to the barrel-receiving bore, and an extractor head recess is formed in the main body at the breech end thereof and extends into the smooth-walled portion of the barrel-receiving bore. The extractor head recess extends into the lug to merge with the extractor channels to form an extractor receptacle.

In a preferred embodiment, the barrel-receiving bore further comprises a smooth-walled portion extending from the breech end toward the discharge end.

The lug may further comprise an extractor stop interposed between the locking bolt receptacle and the extractor receptacle, with the extractor stop being in registration with the extractor head recess. In particular embodiments, the extractor stop has a sloped leading edge on a surface thereof proximal to the extractor head recess.

The barrel adaptor may further comprise an extractor. In one embodiment, the extractor comprises an extractor head having an arcuate recess including a cartridge-engaging lip adapted to engage a cartridge extraction surface and a pair of opposed, spaced apart substantially parallel extractor arms extending from a first side of the extractor head. Each extractor arm may have an inclined cam surface at a distal end thereof, relative to the extractor head, and the extractor arms are received in the extractor channels so that the extractor is longitudinally movable between a firing configuration in which the extractor head is received in the extractor head recess and an extended configuration in which the extractor head is withdrawn outwardly from the extractor head recess.

In particular embodiments, at least when the extractor is in the extended configuration, the extractor arms can pivot within the extractor channels so that the extractor head can pivot toward and away from the main body.

The barrel adaptor may further comprise at least one biasing member acting between the lug and the extractor to urge the extractor head toward the main body. In certain embodiments, the biasing member(s) may comprise two opposed biasing members, with each biasing member acting between the lug and a respective extractor arm. In such embodiments, each biasing member may urge a respective limiter pin into engagement with a respective extractor arm on a surface of the extractor arm facing toward the lug to limit movement of the extractor. In particular implementations of these embodiments, the lug has two opposed biasing bores formed therethrough, with the biasing bores arranged substantially perpendicular to the crossbore and substantially perpendicular to the barrel-receiving bore. The biasing bores are disposed between the crossbore and the extractor head recess, and the biasing members are coil springs. At least one retaining element is received in the biasing bores at ends thereof remote from the extractor channels, each of the limiter pins and biasing members being received in a respective biasing bore such that each limiter pin is trapped between the respective extractor arm and the respective biasing member, and each biasing member is trapped between the respective limiter pin and the retaining element(s).

The barrel adaptor may further comprise a fore-end mount protruding from the main body between the lug and the discharge end, with the fore-end mount being spaced from and in registration with the lug.

The barrel adaptor may further comprise a mounting rail on the main body opposite the lug, with the mounting rail and the main body being of monolithic construction.

In another aspect, the present disclosure describes a barrel assembly for a single-shot break-action firearm. The barrel assembly comprises a barrel having a breech end and a discharge end. The barrel has a chamber formed at the breech end, with the chamber adapted to receive a cartridge, and the barrel has a bore extending therethrough from the discharge end to the chamber. The bore is co-axial with the chamber. A lug protrudes from the barrel adjacent the breech end; the lug is adapted for mounting to a single-shot break-action firearm receiver assembly. The lug has a crossbore extending through the lug substantially perpendicularly to the bore and adapted to receive a hinge pin, with the crossbore disposed at a first end of the lug distal from the breech end. A locking bolt receptacle is formed in the lug and adapted to receive a locking bolt and a locking bolt spring; the locking bolt receptacle is disposed at a second end of the lug proximal to the breech end. A pair of opposed parallel extractor channels is formed in the barrel assembly between the chamber and the locking bolt receptacle, with the extractor channels being substantially parallel to the chamber and the bore. An extractor head recess is formed in the barrel at the breech end thereof and extends into the chamber. The extractor head recess extends into the lug to merge with the extractor channels to form an extractor receptacle.

The barrel assembly may in other respects be similar to the barrel adaptor described above.

In a further aspect, the present disclosure describes an extractor. The extractor comprises an extractor head having an arcuate recess including a cartridge-engaging lip adapted to engage a cartridge extraction surface, and a pair of opposed, spaced apart substantially parallel extractor arms extending from a first side of the extractor head.

Each extractor arm may have an inclined cam surface at a distal end thereof, relative to the extractor head, and each extractor arm may have a retention recess formed in a surface thereof facing away from the arcuate recess.

BRIEF DESCRIPTION OF THE DRAWINGS

These and other features will become more apparent from the following description in which reference is made to the appended drawings wherein.

DETAILED DESCRIPTION

Figure 1:
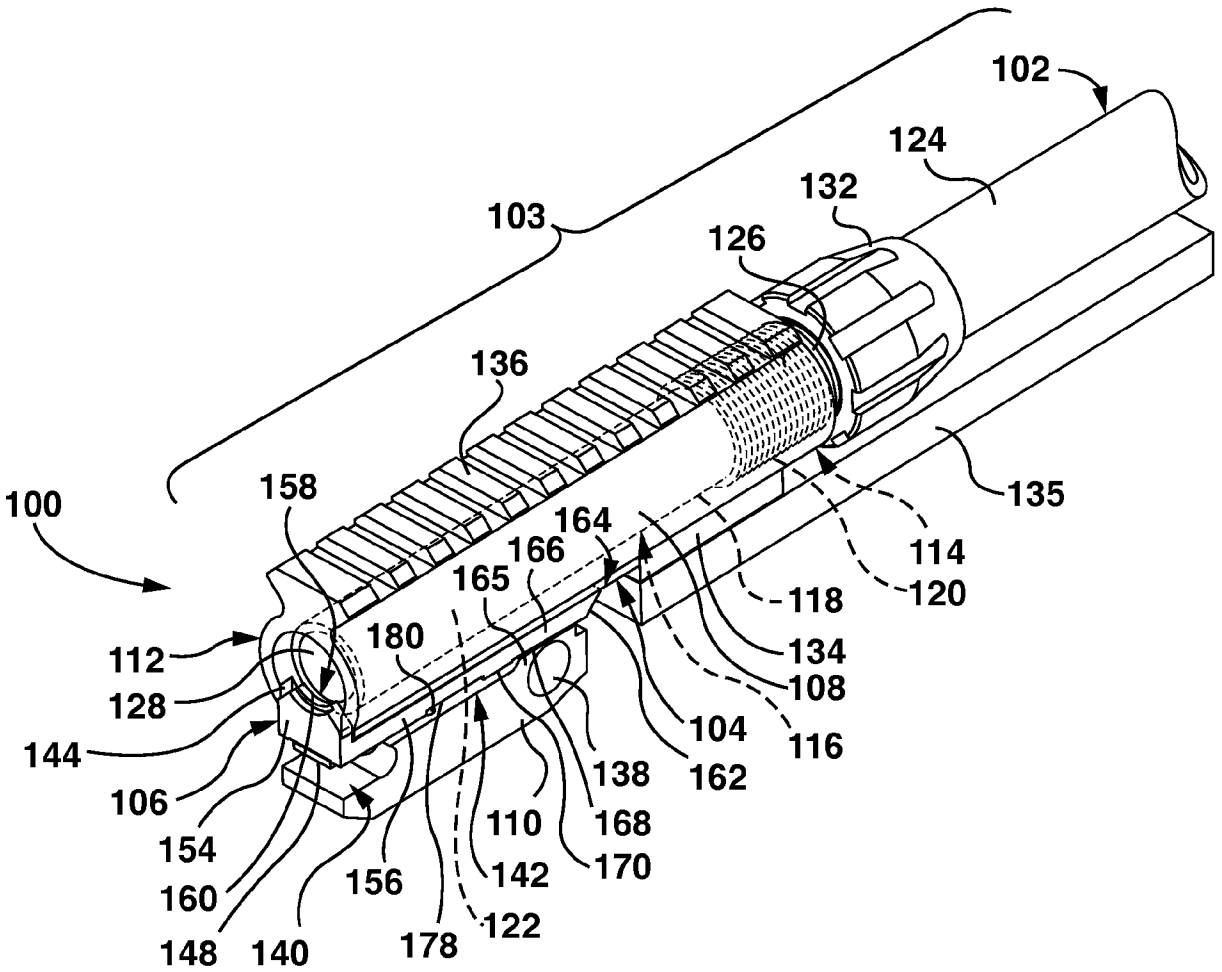
FIG. 1 is a perspective view showing an exemplary barrel adaptor incorporated into a first exemplary barrel assembly for a single-shot break-action firearm.
Figure 2:
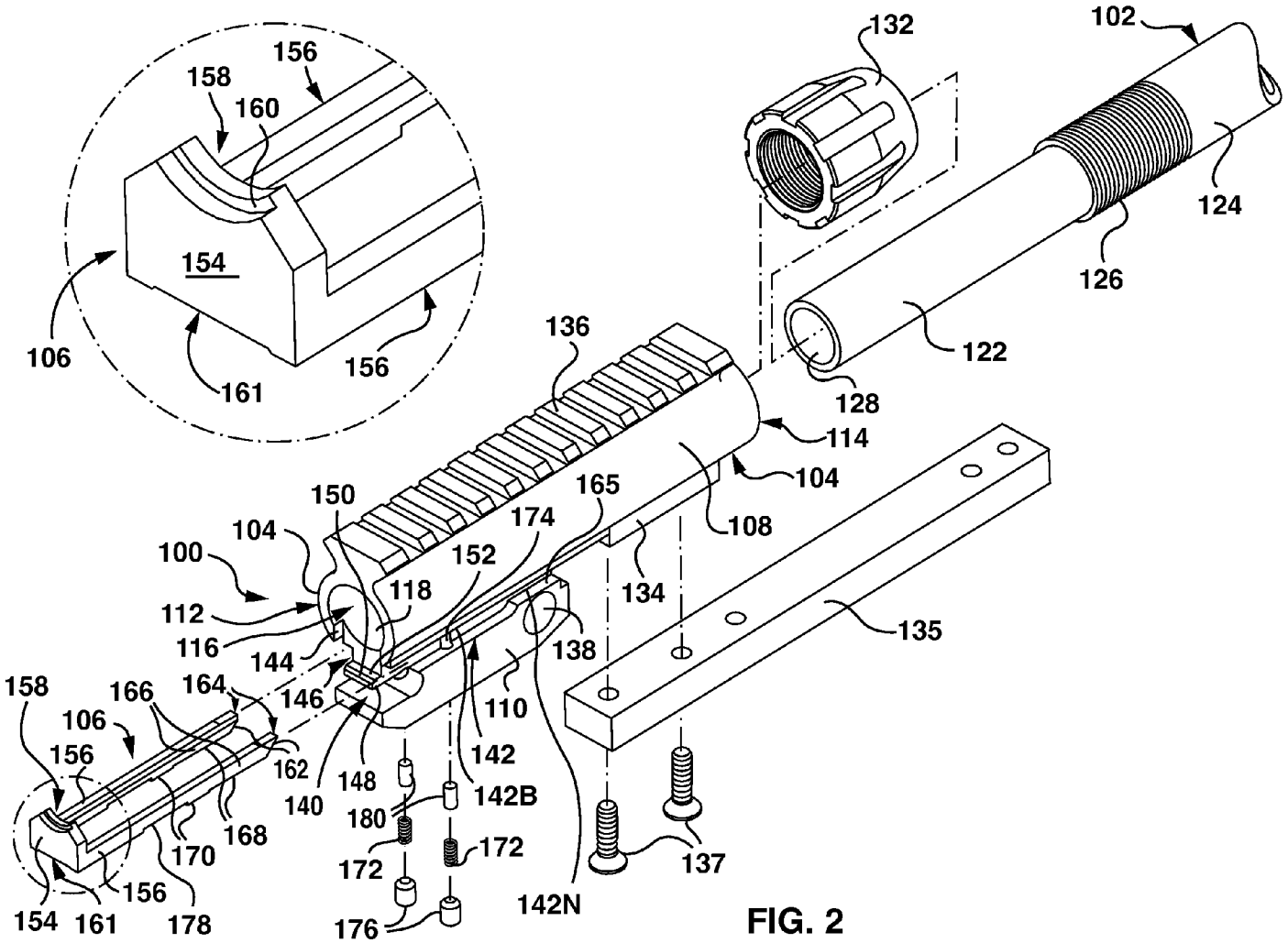
FIG. 2 is an exploded perspective view of the barrel assembly of FIG. 1.
Figure 3:
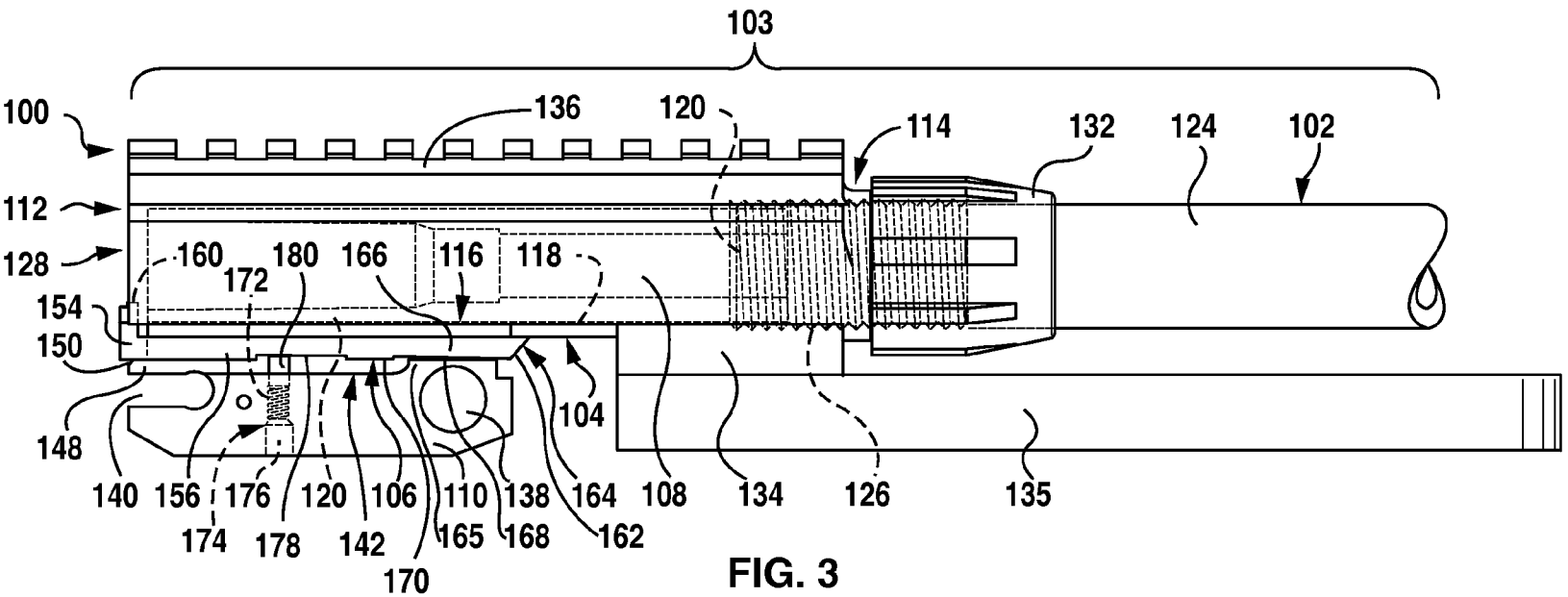
FIG. 3 is a side elevation view of the barrel assembly of FIG. 1.

Reference is now made to FIGS. 1 to 3, in which an exemplary barrel adaptor for a single-shot break-action firearm is indicated generally at reference 100 and shown releasably coupled to a barrel 102 to form a barrel assembly 103. The barrel adaptor 100 comprises a barrel stub 104 and an extractor 106. A single-shot break-action firearm incorporating the barrel adaptor 100 can be adapted to fire different types of ammunition by replacing the barrel 102 and extractor 106.

The barrel stub 104 comprises a main body 108 and a lug 110 adapted for mounting the barrel adaptor 100 to a suitable single-shot break-action firearm receiver assembly, such as a Contender-style receiver assembly, in known manner. The barrel stub 104, including the main body 108 and lug 110, are preferably of monolithic construction. The main body 108 of the barrel stub 104 has a breech end 112 and a discharge end 114, and a barrel-receiving bore 116 extends through the main body 108 from the breech end 112 to the discharge end 114. The barrel-receiving bore 116 comprises a smooth-walled portion 118 extending from the breech end 112 toward the discharge end 114 and an internally threaded portion 120 extending from the discharge end 114 toward the breech end 116.

As best seen in FIG. 2 although also shown in FIGS. 1 and 3, the barrel 102 is releasably interengageable with the barrel adaptor 100. The barrel 102 comprises a chamber portion 122 at one end thereof and a main barrel portion 124 extending from the chamber portion 122, with an externally threaded portion 126 disposed between the chamber portion 122 and the main barrel portion 124. A chamber 128 is formed in the chamber portion 122 of the barrel 102; a single-shot break-action firearm incorporating the barrel adaptor 100 can be adapted for use with different types and calibers of ammunition by changing the barrel that is releasably interengaged with the barrel adaptor 100 and installing an appropriately dimensioned extractor. An internally threaded locknut 132 is threaded onto the externally threaded portion 126 of the barrel 102. The barrel 102 may be secured to the barrel adaptor 100 by inserting the chamber portion 122 of the barrel 102 into the discharge end 114 of the barrel-receiving bore 116 of the barrel stub 104 and interengaging the internally threaded portion 120 of the barrel-receiving bore 116 with the externally threaded portion 126 of the barrel 102. The externally threaded portion 126 of the barrel 102 can then be threaded into or out of the internally threaded portion 120 of the barrel-receiving bore 116 to achieve a desired longitudinal position of the chamber portion 122 of the barrel 102 within the barrel-receiving bore 116. Certain features for adjusting the longitudinal position of the chamber portion 122 of the barrel 102 within the barrel-receiving bore 116 to achieve desired headspace are described further below. Once the desired longitudinal position has been set, the barrel 102 can be secured in that longitudinal position by tightening the locknut 132 against the discharge end 114 of the main body 108 of the barrel stub 104.

In the illustrated embodiment, a fore-end mount 134 protrudes from the main body 108 of the barrel stub 104, between the lug 110 and the discharge end 114 of the main body 108. The fore-end mount 134 is spaced from and in registration with the lug 110 and is adapted to receive a fore-end member 135 which can in turn receive a suitable grip. Preferably, the fore-end mount 134 is formed monolithically as part of the barrel stub 104. The fore-end member 135 can be secured to the fore-end mount 134 by, for example, bolts 137.

Also in the illustrated embodiment, the barrel adaptor 100 further comprises a mounting rail 136 on the main body 108 of the barrel stub 104, opposite the lug 110; the mounting rail 136 and the main body 108 are preferably also of monolithic construction so that the mounting rail 136 is also formed monolithically as part of the barrel stub 104. The mounting rail 136 is used to mount attachments (not shown) such as scopes, laser sights, tactical lights or the like, and may be of any suitable type. For example, the mounting rail 136 may be dimensioned to conform to the Weaver standard or the Picatinny standard, among others.

The lug 110 protrudes from the main body 108 of the barrel stub 104 adjacent the breech end 112.

Figure 9:
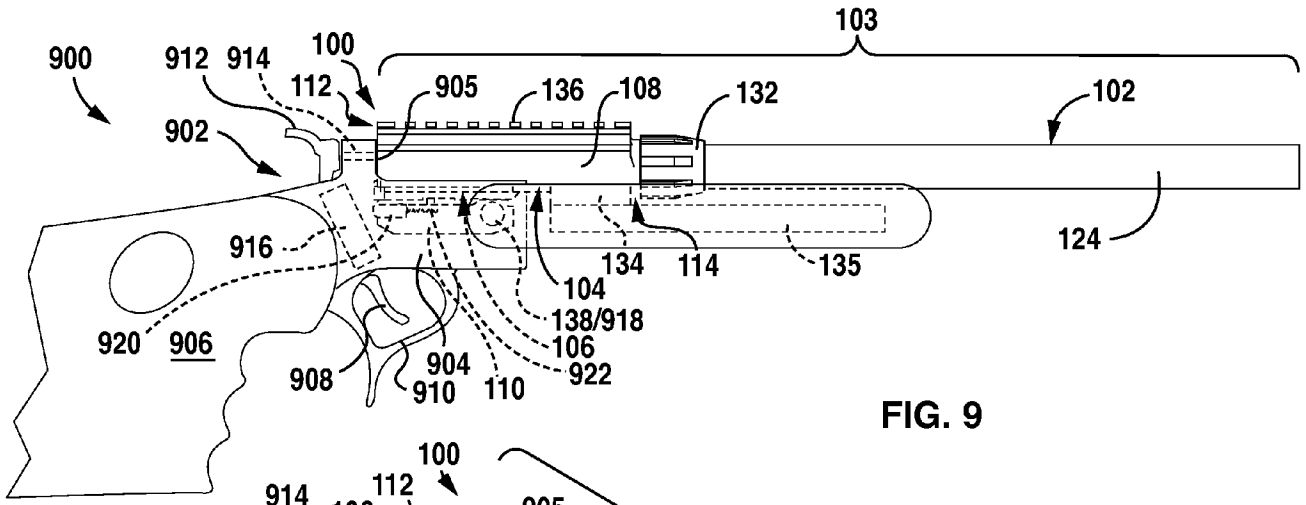
FIG. 9 is a side elevation view of an exemplary single-shot break-action firearm incorporating the barrel assembly of FIG. 1, showing the firearm in a breech closed configuration.
Figure 9A:
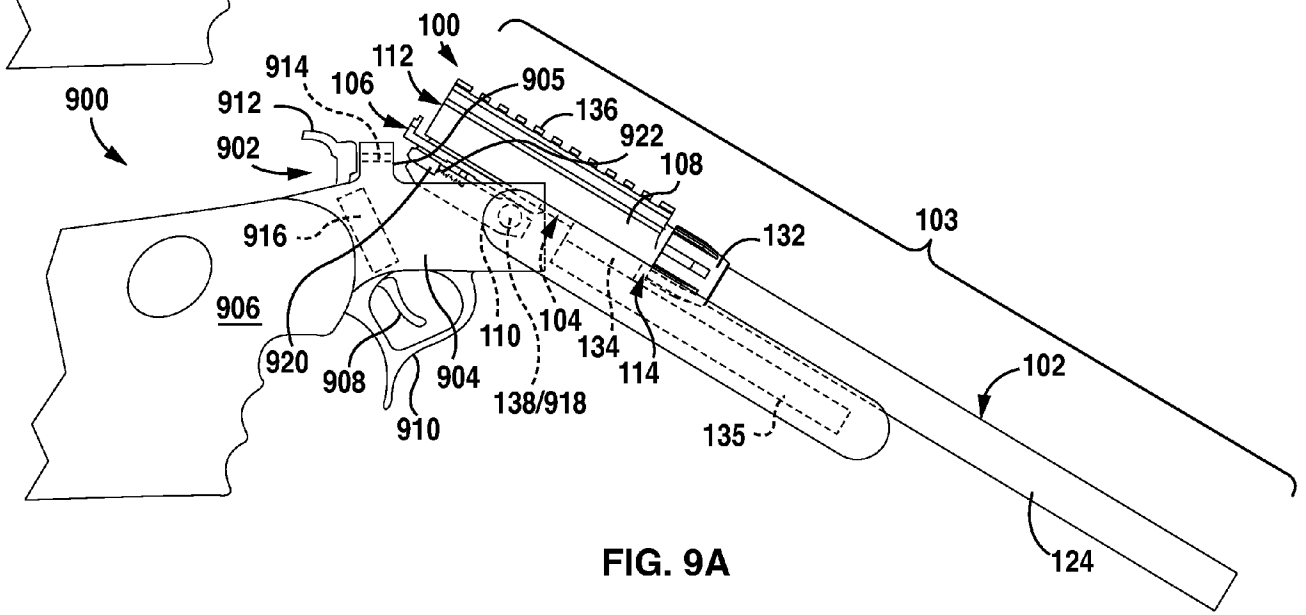
FIG. 9A is a side elevation view of the firearm of FIG. 9, showing the firearm in a breech open configuration.

As noted above, the lug 110 is adapted for mounting the barrel adaptor 100 to a suitable single-shot break-action firearm receiver assembly, such as a Contender-style receiver assembly, to form a complete single-shot break-action firearm as is known in the art. FIGS. 9 and 9A show an exemplary single-shot break-action firearm 900 comprising a receiver assembly 902, barrel adaptor 100 and barrel 102. FIG. 9 shows the firearm 900 in a breech closed (firing) configuration and FIG. 9A shows the firearm 900 in a breech open (loading/unloading) configuration. The receiver assembly 902 may be conventional, such as a Contender-style receiver assembly, and includes a receiver body 904 and a grip 906. The grip 906 is merely exemplary, and other types of grip, such as one with an integrated buttstock and thumbhole design may also be used. The receiver body 904 defines a breech face 905 and carries a trigger 908, trigger guard 910, hammer 912 and at least one firing pin 914 (Contender-style receiver assemblies include two firing pins, one for rimfire cartridges and one for centerfire cartridges, and a selection mechanism (not shown) is included in the hammer for selecting between the two firing pins). An action mechanism 916, shown schematically for simplicity of illustration, couples the trigger 908 to the hammer 912 so that pulling the trigger 908 will release the hammer 912 from a cocked position to drive the (selected) firing pin 914 towards the chamber 128. To facilitate mounting of the barrel adaptor 100 to a receiver assembly (e.g. exemplary receiver assembly 902) a crossbore 138 extends through the lug 110 substantially perpendicularly to the barrel-receiving bore 116 and a locking bolt receptacle 140 is formed in the lug 110. The crossbore 138 is disposed at a first end of the lug 110 distal from the breech end 112 and the locking bolt receptacle 140 is disposed at a second end of the lug 110 proximal to the breech end 112. The crossbore 138 is adapted to receive a hinge pin 918 passing through the receiver body 904 so that the barrel adaptor 100 can pivot relative to the receiver assembly 902, and the locking bolt receptacle 140 is adapted to receive a locking bolt 920 (FIG. 9A) and a locking bolt spring 922 in known manner. In the breech closed configuration shown in FIG. 9, the locking bolt 920 engages and is retained by an internal lug/platform within the receiver body 904 to secure the firearm 900 in the breech closed configuration. The trigger guard 910 can be pivoted toward the grip 906 to release the bolt and enable the barrel adaptor 100 to be pivoted relative to the receiver assembly 902 to place the firearm 900 in the breech open configuration shown in FIG. 9A. Single-shot break-action firearm receiver assemblies of the type described above are well-known in the firearm arts and further details are omitted for brevity.

Referring again to FIG. 2, a pair of opposed parallel extractor channels 142 is formed in the barrel stub 104 between the barrel-receiving bore 116 and the locking bolt receptacle 140. The extractor channels 142 are substantially parallel to the barrel-receiving bore 116 and an extractor head recess 144 is formed in the main body 108 at the breech end 112 thereof and extends into the smooth-walled portion 118 of the barrel-receiving bore 116. The extractor head recess 144 extends into the lug 110 to merge with the extractor channels 142 so as to form an extractor receptacle, denoted generally by reference 146. The lug 110 further comprises an extractor stop 148 interposed between the locking bolt receptacle 140 and the extractor receptacle 146 in registration with the extractor head recess 144. As best seen in FIG. 2, the extractor stop 148 has a sloped leading edge 150 on a surface 152 thereof proximal to the extractor head recess 144.

Continuing to refer primarily to FIG. 2, the extractor receptacle 146 receives an extractor 106. The extractor 106 comprises an extractor head 154 and a pair of opposed, spaced apart substantially parallel extractor arms 156 extending from a first side of the extractor head 154. The extractor head 154 has an arcuate recess 158 including a cartridge-engaging lip 160 adapted to engage a cartridge extraction surface. As used herein, the term "cartridge extraction surface" refers to the surface of the rim facing toward the neck of the cartridge case, and applies to both rimmed cartridges, in which the rim extends outwardly from the body of the cartridge case and to so-called "rimless" cartridges in which the rim is flush with, or rebated from, the body of the cartridge case and separated therefrom by an extractor groove. The extractor head 154 also includes a cut-out 161 opposite the arcuate recess 158 to accommodate the extractor stop 148.

The extractor arms 156 are slidably received in the extractor channels 142, whereby the extractor 106 is longitudinally movable between a firing configuration (FIG. 4E) in which the extractor head 154 is received in the extractor head recess 144 and an extended configuration (FIGS. 5C and 5E) in which the extractor head 154 is withdrawn outwardly from the extractor head recess 144. Each extractor arm 156 has an inclined cam surface 162 at a distal end 164 thereof, relative to the extractor head 154. The inclined cam surfaces 162 cooperate with a corresponding cam member (not shown) on the receiver assembly (e.g. receiver assembly 902) of a conventional single-shot break-action firearm such as a Contender-style firearm. In particular, when the barrel adaptor 100 is pivoted relative to the receiver assembly from a breech closed (firing) configuration to a breech open (loading/unloading) position, the cam member on the receiver assembly engages the cam surfaces 160 on the extractor arms 156 to push the extractor 106 from the firing configuration toward the extended configuration.

Preferably, at least when the extractor 106 is in the extended configuration, the extractor arms 156 can pivot within the extractor channels 142 so that the extractor head 154 can pivot toward and away from the main body 108. As best seen in FIG. 2, in the illustrated embodiment the extractor channels 142 each include a relatively broader portion 142B and a relatively narrower portion 142N. The relatively narrower portion 142N of each extractor channel 142 is formed by a salient 165 in the extractor channel 142 located generally in registration with the crossbore 138. The salients 165 are formed in the surfaces of the extractor channels 142 that are furthest from the barrel-receiving bore 116 and hence those surfaces are stepped toward the barrel-receiving bore 116 in the region of the salients 165. The relatively narrower portions 142N of the extractor channels 142 serve as guides for longitudinal movement of the extractor arms 156 while the relatively broader portions 142B of the extractor channels 142 provide room for the extractor arms 156 to pivot within the extractor channels 142. To facilitate pivoting of the extractor arms 156 within the extractor channels 142, the portions 166 of the extractor arms 156 that are received in the relatively narrower portions 142N of the extractor channels 142 (i.e. the portions 166 adjacent the distal ends 164 of the extractor arms 156) are tapered along their inferior surfaces 168 (the surfaces facing away from the arcuate recess 158). Specifically, the inferior surfaces 168 of the portions 166 of the extractor arms 156 that are received in the relatively narrower portions 142N are tapered so that the thickness of each extractor arm 156 decreases with increasing distance from the distal end 164 thereof, ending at an outward step 170.

Figure 3B:
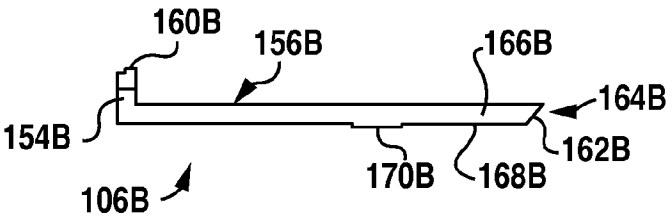
FIG. 3B shows a second alternate embodiment of an extractor.
Figure 3A:
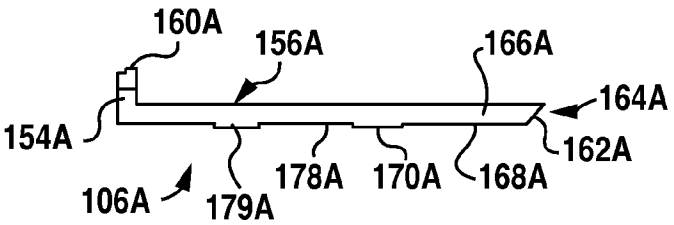
FIG. 3A shows a first alternate embodiment of an extractor.

A first alternate embodiment of an extractor 106A is shown in FIG. 3A, in which like reference numerals denote like features except with the suffix "A". The portions 166A of the extractor arms 156A that are received in the relatively narrower portions 142N are of constant thickness (i.e. do not taper), and are narrower than the relatively narrower portions 142N of the extractor channels 142 so as to provide enough play to permit pivoting while retaining the guide function of the relatively narrower portions 142N. In addition, in the alternate embodiment of the extractor 106A shown in FIG. 3A, the retention recesses 178A are formed between the outward step 170A and a second outward step 179A. In the first alternate extractor 106A shown in FIG. 3A, the extractor head 154A and the portions of the extractor arms 156A between the extractor head 154A and the second outward step 179A are narrower than in the extractor 106 shown in FIGS. 1 to 3. This obviates the need for a cut-out (like cutout 161 in the extractor 106 shown in FIGS. 1 to 3) since the narrower extractor head 154A can accommodate the extractor stop 148.

In a second alternate embodiment of an extractor 106B, shown in FIG. 3B where like reference numerals denote like features except with the suffix "B", the retention recesses are omitted in favor of a single profile from the extractor head 154B to the step 170B; the step 170B will limit movement of the extractor 106B away from the discharge end 114 and the extractor head 154B will limit movement of the extractor 106B toward from the discharge end 114.

In preferred embodiments, the barrel adaptor 100 further comprises at least one biasing member acting between the lug 110 and the extractor 106 to urge the extractor head 154 toward the main body 108, and in particularly preferred embodiments, two opposed biasing members are provided, with each biasing member acting between the lug 110 and a respective extractor arm 156. In the illustrated embodiment, two opposed biasing members in the form of coil springs 172 are provided.

The lug 110 has two opposed biasing bores 174 formed therethrough for receiving the coil springs 172. The biasing bores 174 are arranged substantially perpendicularly to the crossbore 138 and substantially perpendicularly to the barrel-receiving bore 116, and are disposed between the crossbore 138 and the extractor head recess 144. Retaining elements in the form of setscrews 176 are received in the biasing bores 174 at the ends thereof that are remote from the extractor channels 142. In other embodiments, a single retaining element may be used for both biasing bores; for example a retaining bore may extend through the lug, generally parallel to the crossbore and intersecting the biasing bore, to receive a crosspin as a single retaining element.

Each extractor arm 156 has a retention recess 178 formed in the inferior surface 168 thereof, that is, the surface 168 of the extractor arm 156 facing toward the lug 110 and away from the arcuate recess 158. The retention recesses 178 are in registration with one another.

In addition to the coil springs 172 and setscrews 176, limiter pins 180 are also received in the biasing bores 174. The coil springs 172, setscrews 176 and limiter pins 180 are each received in a respective biasing bore 174 such that each limiter pin 180 is trapped between the respective extractor arm 156 and the respective coil spring 172 and the coil spring 172 is trapped between the respective limiter pin 180 and the setscrew 176. The result is that each coil spring 172 urges a respective limiter pin 180 into engagement with a respective extractor arm 156 within the retention recess 178 thereof to limit longitudinal movement of the extractor 106 along the extractor channels 142. When the limiter pins 180 are at the ends of the retention recesses 178 closest to the distal ends 164 of the extractor arms 156, the extractor 106 will be in the extended configuration. When the extractor 106 is in the firing position, however, the limiter pins 180 may be slightly spaced from the ends of the retention recesses 178 furthest from the distal ends 164 of the extractor arms 156 (see FIG. 5A).

As noted above, the extractor 106 is dimensioned for the particular ammunition with which it will be used. According to one exemplary method, the extractor 106 may be removed by loosening the set screw 176 to allow the limiter pins 180 to disengage from the retention recesses 178 and then sliding the extractor 106 away from the breech end 112 of the main body 108. A new extractor 106 can then be installed by sliding the new extractor 106 into position and then tightening the set screws 176, which applies pressure to the coil springs 172, thereby urging the limiter pins 180 into the retention recess 178 of the new extractor 106. In another exemplary method, the extractor 106 may be removed from the barrel stub 104 by manually depressing the limiter pins 180 against the coil springs 172 to move them out of the retention recesses 178 and then sliding the extractor 106 away from the breech end 112 of the main body 108. A new extractor can then be installed by inserting the distal ends 164 of the extractor arms 156 into the extractor channels 142 and sliding the extractor toward the breech end 112 of the main body 108. As the distal ends 164 of the extractor arms 156 encounter the limiter pins 180, the inclined cam surfaces 162 will push the limiter pins 180 into the biasing bores 174 so that the inferior surfaces 168 of the end portions 166 of the extractor arms 156 can slide along the limiter pins 180 until the limiter pins 180 are in registration with the retention recesses 178. Once the limiter pins 180 are in registration with the retention recesses 178, the biasing force of the coil springs 172 will move the limiter pins 180 into the retention recesses 178 to retain the extractor. In addition, if the extractor 106 shown in FIG. 3B is used, a tool can be provided that can be inserted to depress the limiter pins 180 against the coil springs 172 and used as a guide to withdraw the current extractor 106 and install a new extractor 106.

Operation of the exemplary barrel adaptor 100 and barrel 102 during loading, firing and unloading of a rimless cartridge as part of a single-shot break-action firearm (e.g. the firearm 900 shown in FIGS. 9A and 9B) will now be described with reference to FIGS. 4A to 5E. Although the barrel adaptor 100 would be coupled to a receiver assembly during loading, firing and unloading, in order to simplify illustration, the barrel adaptor 100 and a portion of the barrel 102 are shown in isolation from the receiver assembly. Moreover, while the locking bolt and locking bolt spring would be present during loading, firing and unloading, FIGS. 4A to 5E show the locking bolt receptacle 140 empty in order to more effectively illustrate the positions and movement of the extractor 106.

Figure 4A:
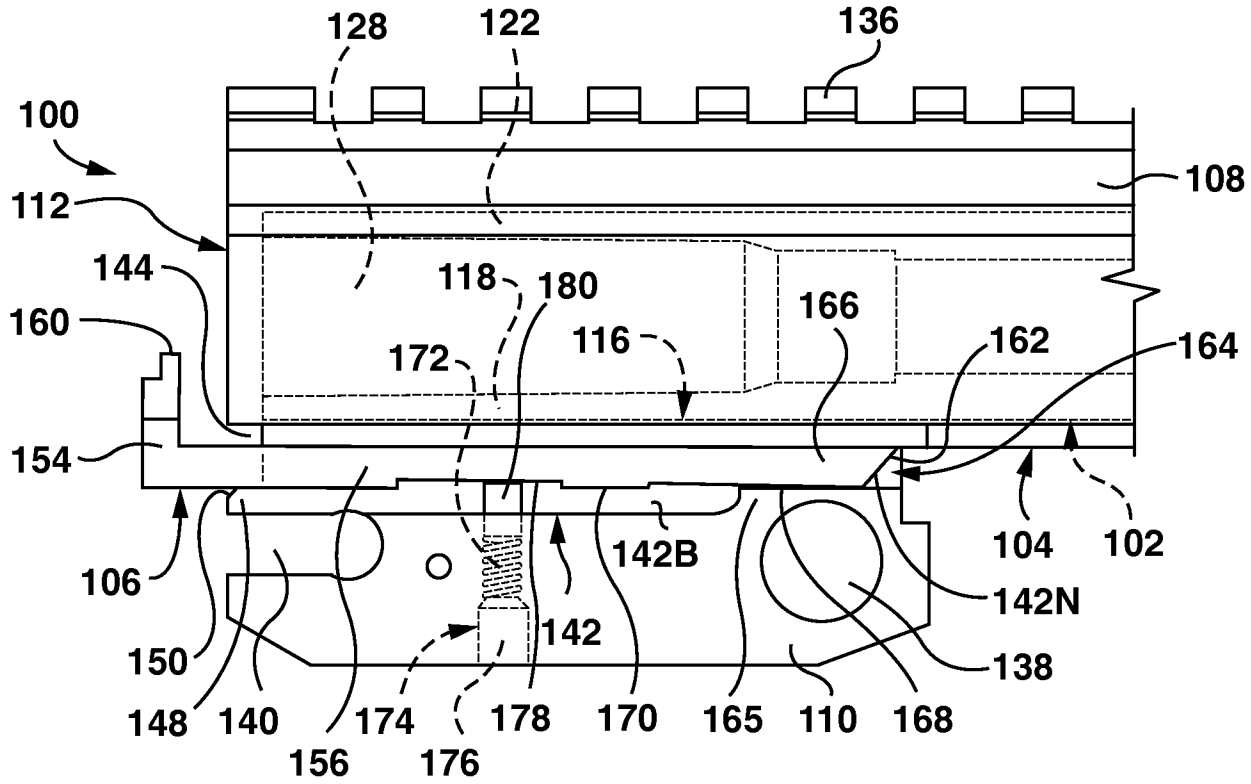
FIGS. 4A to 4E are partially transparent side elevation views of a portion of the barrel assembly shown in FIG. 1, showing loading of a rimless cartridge.

FIG. 4A shows the configuration of the barrel adaptor 100 and barrel 102 with the firearm in a breech open configuration for loading and unloading (e.g. as shown in FIG. 9A), with the chamber 128 empty. It can be seen that the extractor 106 is in an intermediate position between the firing configuration and the extended configuration, although closer to the extended configuration. In particular, when moving the firearm into a breech open configuration, the interaction of the cam member (not shown) on the receiver assembly (not shown) with the inclined cam surfaces 162 on the extractor arms 156 may push the extractor 106 only partially toward the extended configuration. The extractor 106 may be manually pulled into the extended configuration.

Figure 4B:
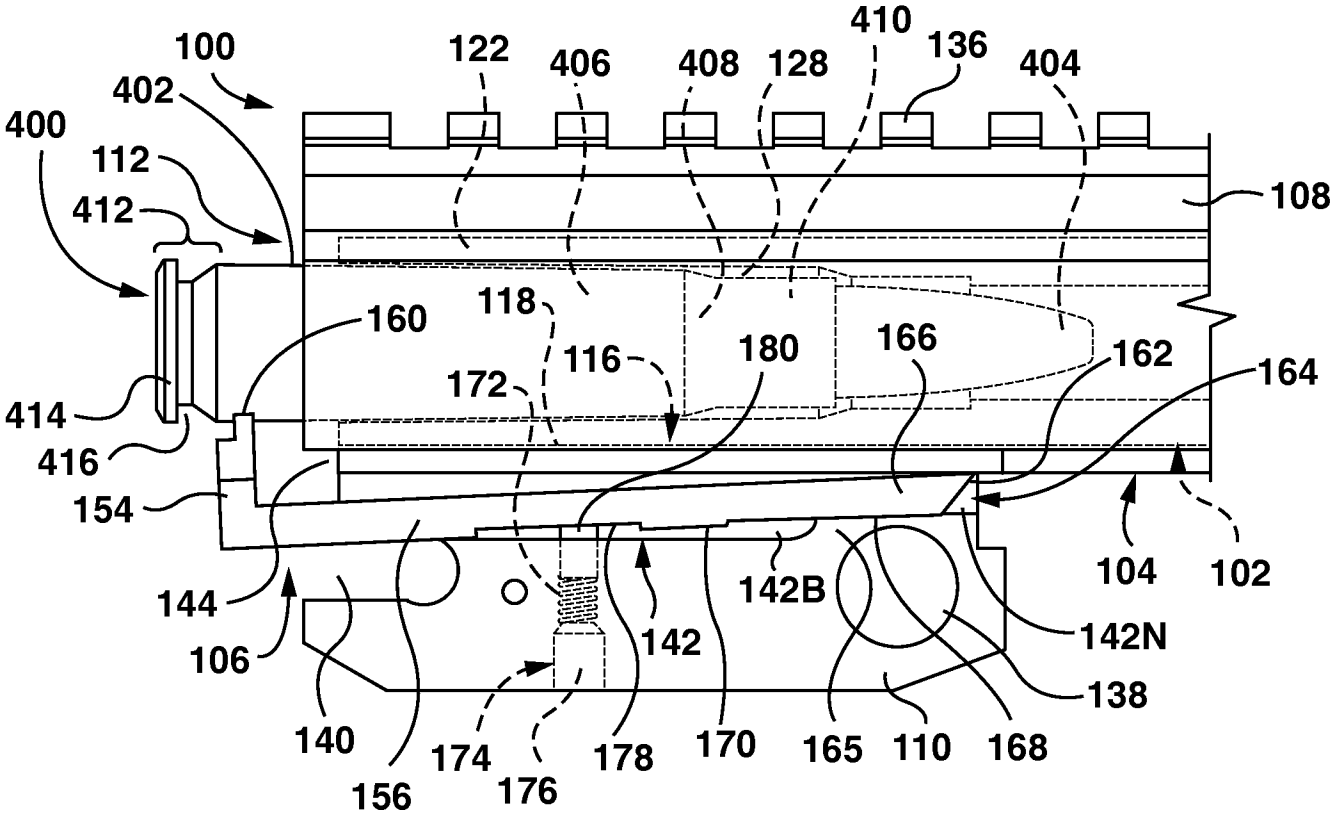

In FIG. 4B, a cartridge, denoted generally by reference 400, has been partially inserted into the chamber 128 through the breech end 112 of the main body 108. The cartridge 400 comprises a cartridge case 402 and a bullet 404. The cartridge 400 is a conventional rimless cartridge, and comprises a body 406 for containing propellant (not shown). As shown in the illustrated embodiment, at one end the body 406 narrows at a shoulder 408 into a neck 410 that receives the bullet 404, and at the other end is a case head 412 (FIG. 4B) that includes a rim 414 separated from the rest of the body 406 by an extractor groove 416. In other embodiments the body of the cartridge case may not narrow at a shoulder. A primer (not shown) is received in the case head 412 which, when struck by a firing pin (e.g. firing pin 914 in FIGS. 9 and 9A) will ignite the propellant in the body 406 and drive the bullet 404 away from the cartridge case 402 in known manner.

Continuing to refer to FIG. 4B, as the cartridge 400 is slid into the chamber 128, the body 406 of the cartridge case 402 engages the extractor head 154, pivoting the extractor head 154 away from the main body 108 against the biasing force exerted by the coil springs 172, which are shown in compression.

Figure 4C:
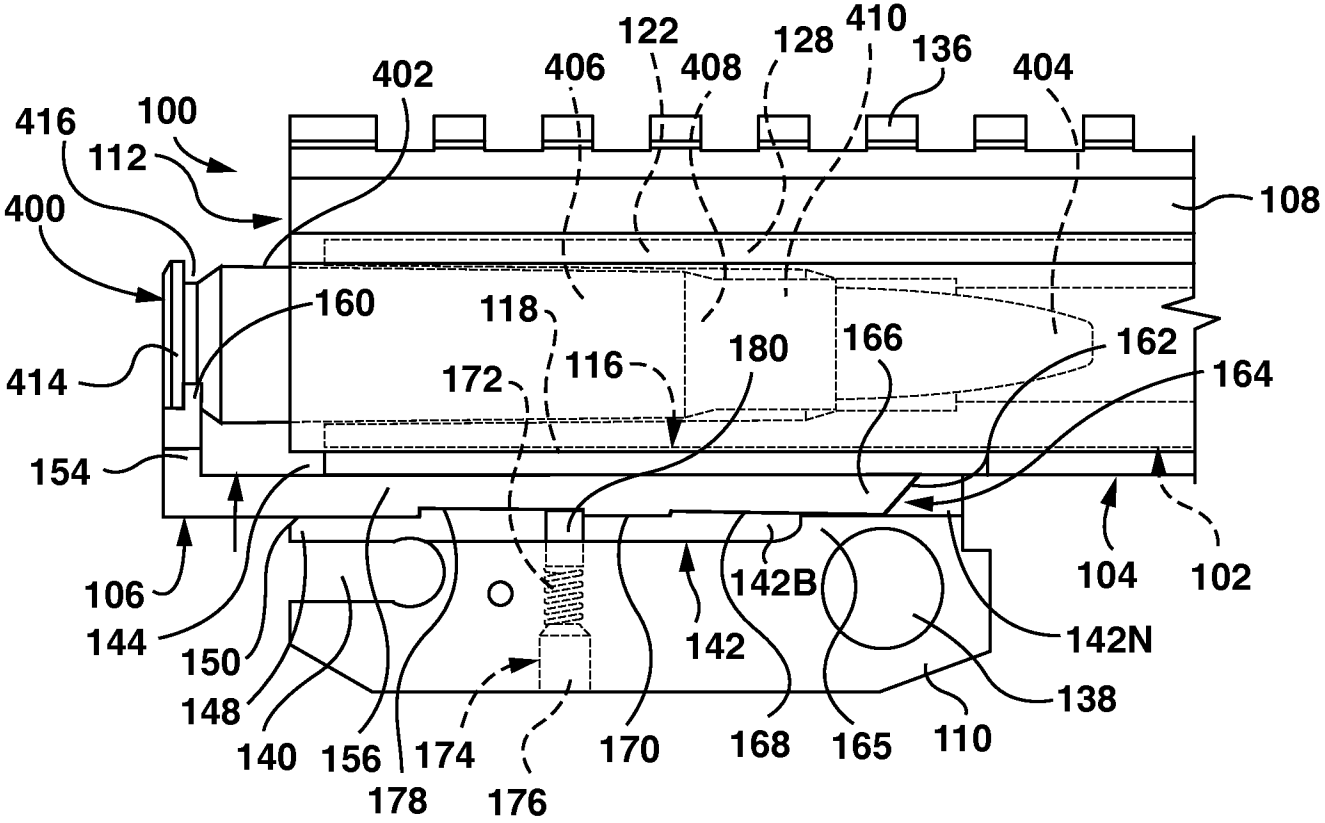

Referring now to FIG. 4C, as the cartridge 400 continues to slide into the chamber 128, the extractor head 154 comes into registration with the extractor groove 416. Since the extractor groove 416 is recessed relative to the body 406 and the rim 414, the biasing force exerted by the coil springs 172 pivots the extractor head 154 back toward the main body 108, causing the cartridge-engaging lip 160 to seat in the extractor groove 416 between the body 406 and the rim 414 of the cartridge.

Figure 4D:
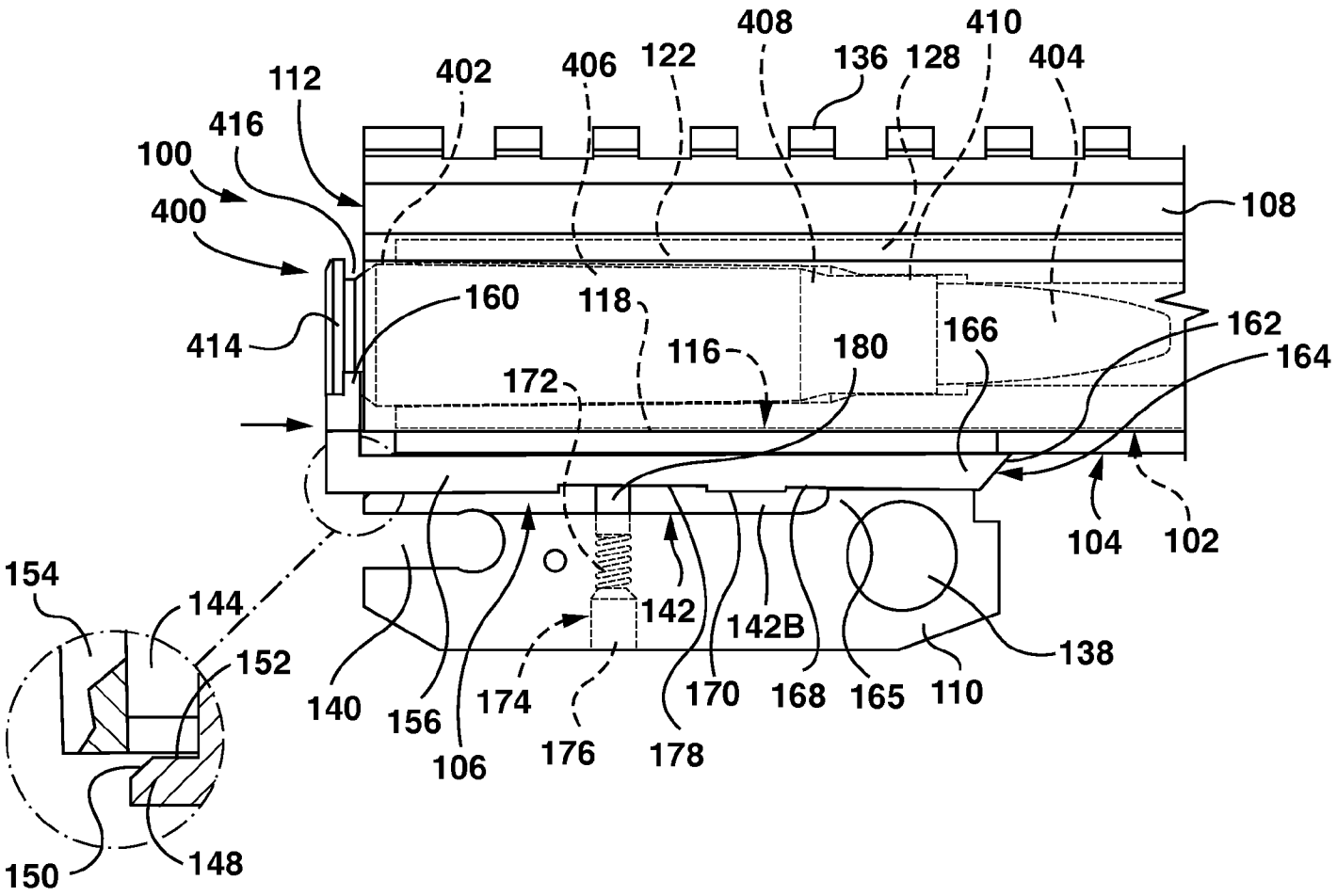
Figure 4E:
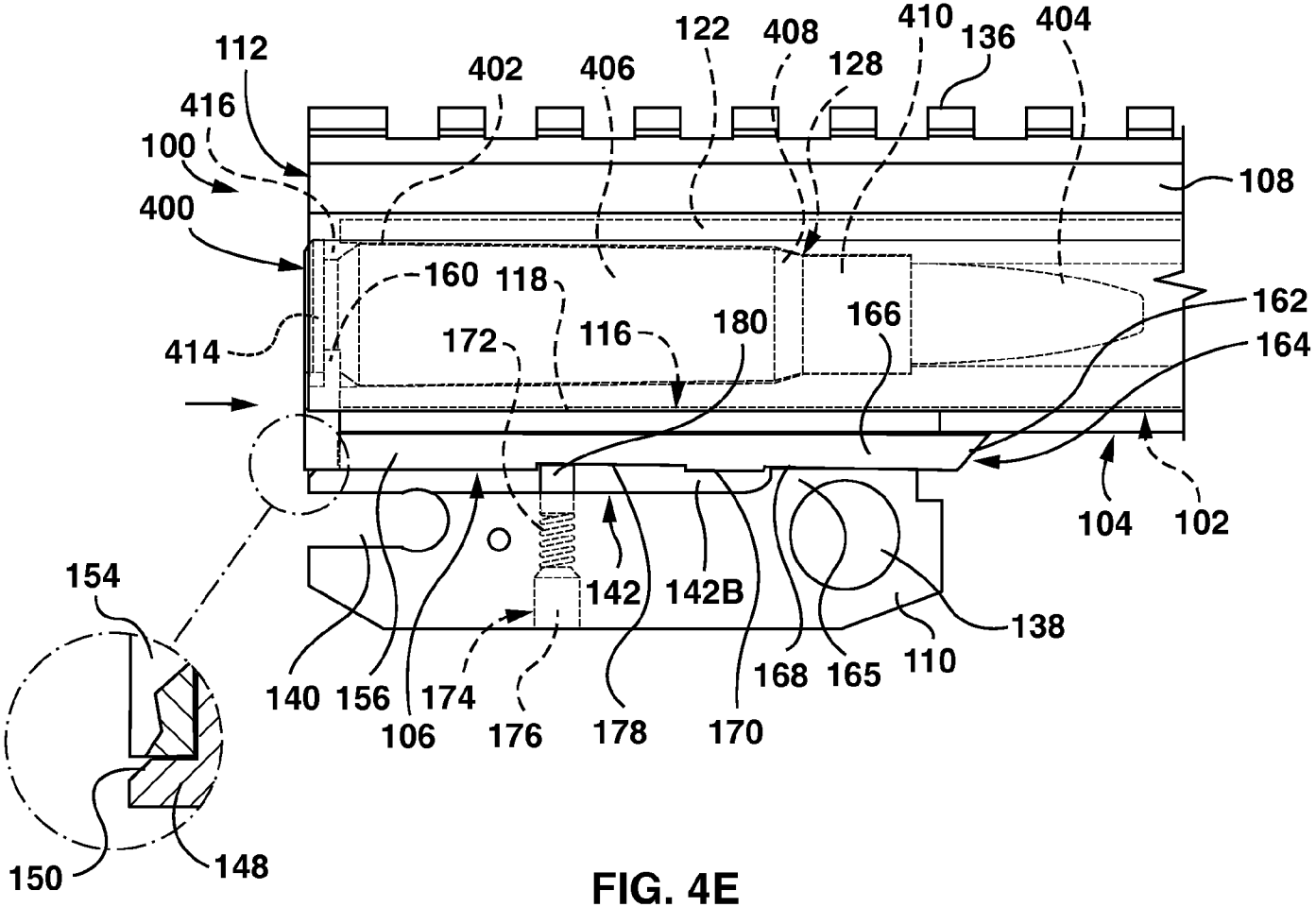

With reference now to FIG. 4D, with the cartridge-engaging lip 160 seated in the extractor groove 416 the extractor 106 and the cartridge 400 will move in unison as the extractor 106 is moved toward the firing configuration. This can be achieved by moving the single-shot break-action firearm into the breech closed configuration (FIG. 9) so that as the receiver assembly 902 pivots relative to the barrel adaptor 100, the breech face 924 (FIGS. 9 and 9A) engages the cartridge 400 and/or the extractor 106. As the breech face 924 (FIGS. 9 and 9A) comes into engagement with the breech end 112 of the main body 108, it pushes the extractor 106 into the firing configuration and chambers the cartridge 400 in the chamber 128. FIG. 4E shows the cartridge 400 chambered with the extractor 106 in the firing configuration; with the firearm in the breech closed configuration (breech closed), the cartridge can be fired in known manner by using the action thereof (e.g. action mechanism 916) to drive the firing pin (e.g. firing pin 914) into the primer (not shown) to ignite the propellant (not shown) in known manner.

Figure 5A:
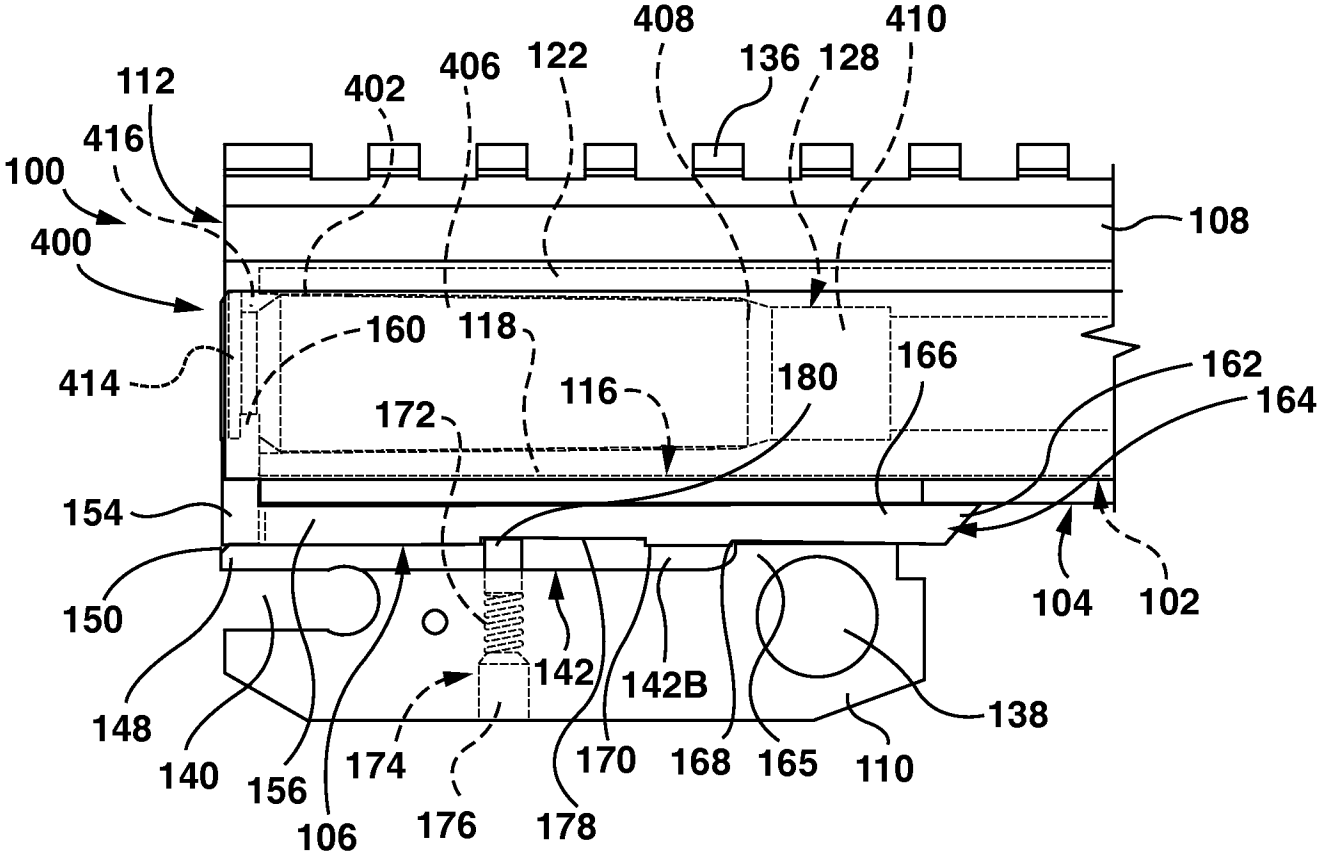
FIGS. 5A to 5E are partially transparent side elevation views of a portion of the barrel assembly shown in FIG. 1, showing unloading of a spent rimless cartridge case.

FIG. 5A shows the condition of the barrel adaptor after the cartridge 400 has been fired, with the single-shot break-action firearm still in the breech closed configuration. The spent cartridge case 402 remains in the chamber (the bullet 404 having been discharged down the barrel 102) and the extractor 106 remains in the firing configuration with the cartridge-engaging lip 160 seated in the extractor groove 416.

Figure 5B:
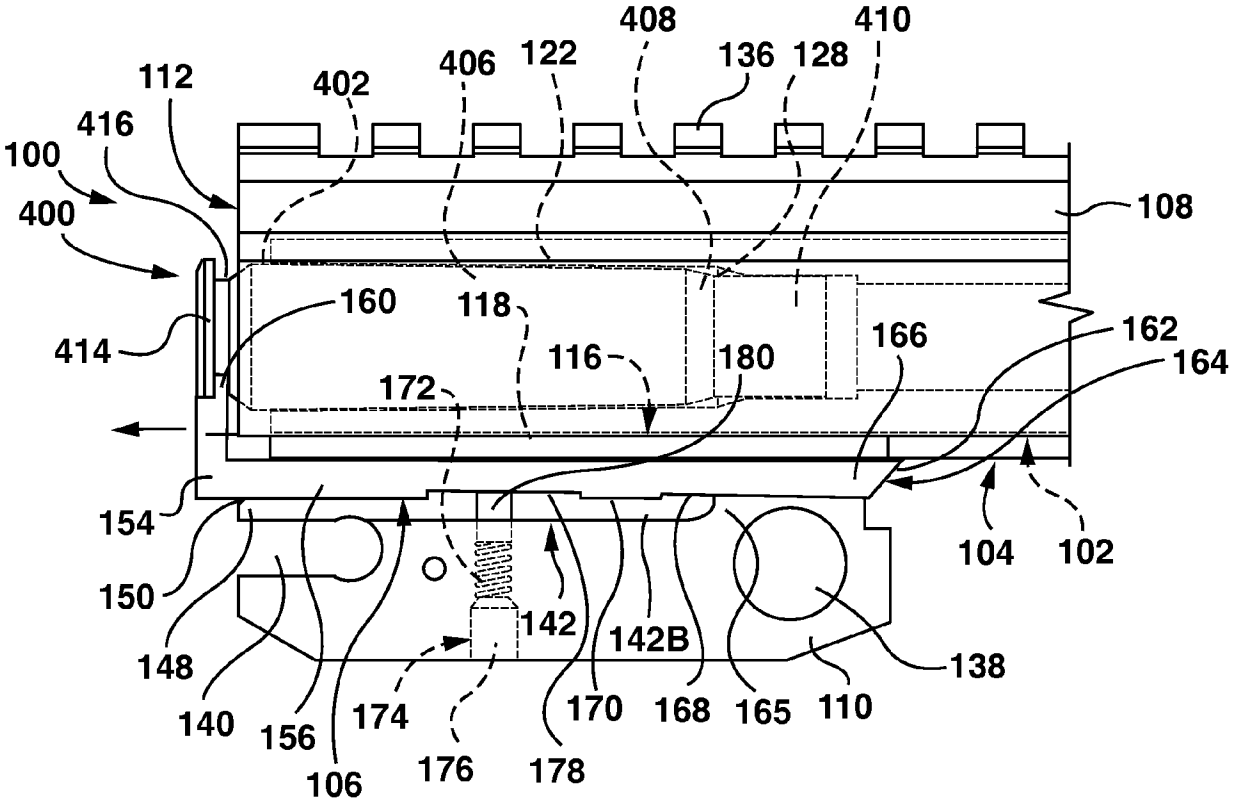

Now referring to FIG. 5B, as the single-shot break-action firearm is moved from the breech closed configuration to the breech open configuration by pivoting the receiver assembly relative to the barrel adaptor 100, the inclined cam surfaces 162 on the distal ends 164 of the extractor arms 156 will engage a cam member (not shown) on the receiver assembly. As the receiver assembly and the barrel adaptor 100 pivot relative to one another, the interaction of the inclined cam surfaces 162 and the cam will begin to move the extractor arms 156, and hence the extractor 106, longitudinally toward the extended configuration, as shown in FIG. 5B. During this first stage of motion, the extractor head 154 is in registration with the extractor stop 148, which obstructs any pivoting by the extractor head 154 away from the main body 108. As a result, until the extractor head 154 moves clear of the extractor stop 148, the extractor 106 is constrained to move longitudinally, generally parallel to the barrel-receiving bore 116. Without promising any particular utility, this constrained longitudinal motion may assist in dislodging a cartridge case 402 whose body 406 is stuck in the chamber 128 (e.g. due to overexpansion). In particular, by obstructing pivoting by the extractor head 154 away from the main body 108, the extractor stop 148 inhibits the cartridge-engaging lip 160 from slipping past the rim 414 of the cartridge case 402 during the initial movement of the extractor 106 out of the firing configuration. This initial movement will typically be sufficient to dislodge a stuck cartridge case 402 from the chamber 128.

Figure 5C:
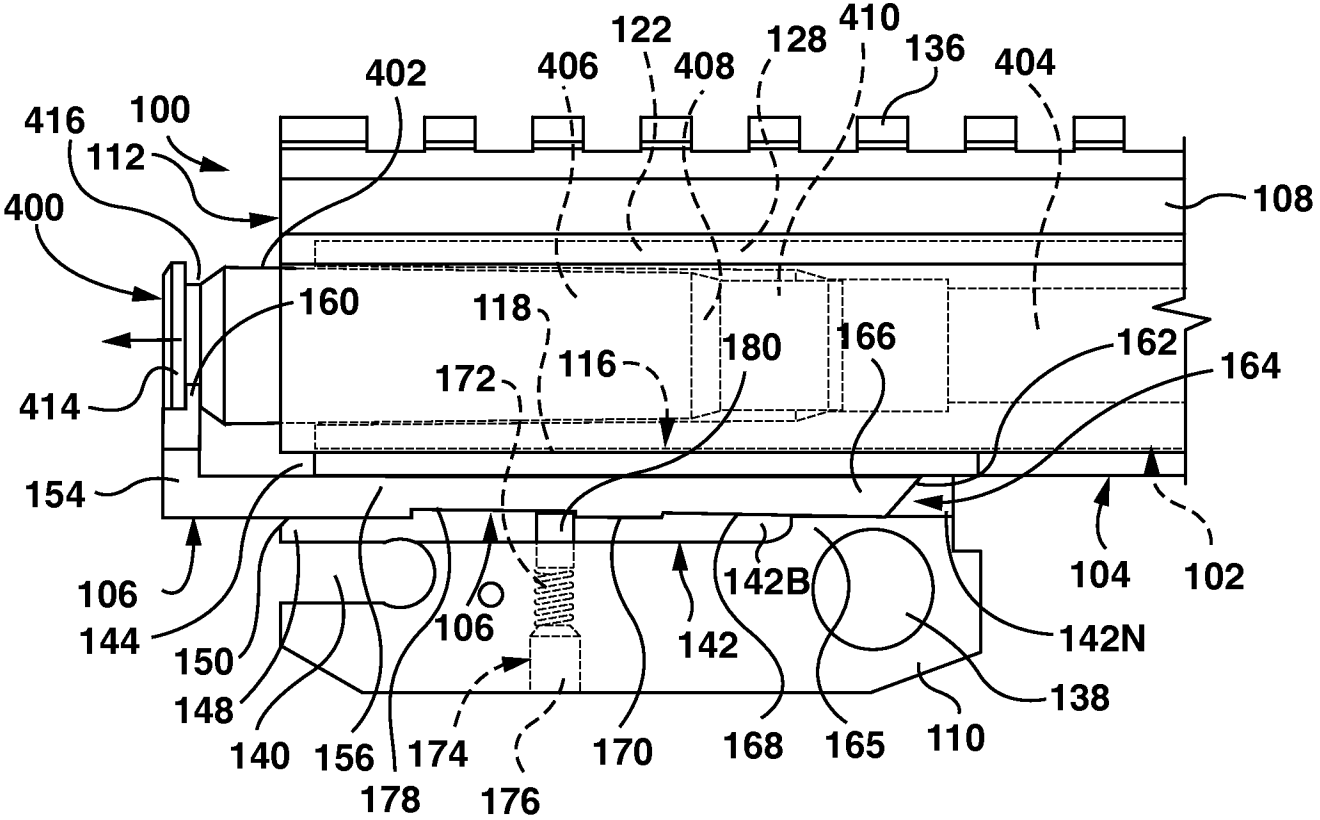

FIG. 5C shows the extractor 106 in the extended configuration, with the cartridge case 402 partially withdrawn from the chamber 128. As noted above, the interaction of the cam member (not shown) on the receiver assembly (e.g. receiver assembly 902) with the inclined cam surfaces 162 on the extractor arms 156 when moving the firearm into an breech open configuration may push the extractor 106 only partially toward the extended configuration. The extractor 106 can be manually pulled into the extended configuration; for example when the cartridge-engaging lip 160 is seated in the extractor groove 416, pulling the cartridge case 402 longitudinally away from the discharge end 114 of the main body 108 may also pull the extractor 106 into the extended configuration.

Figure 5D:
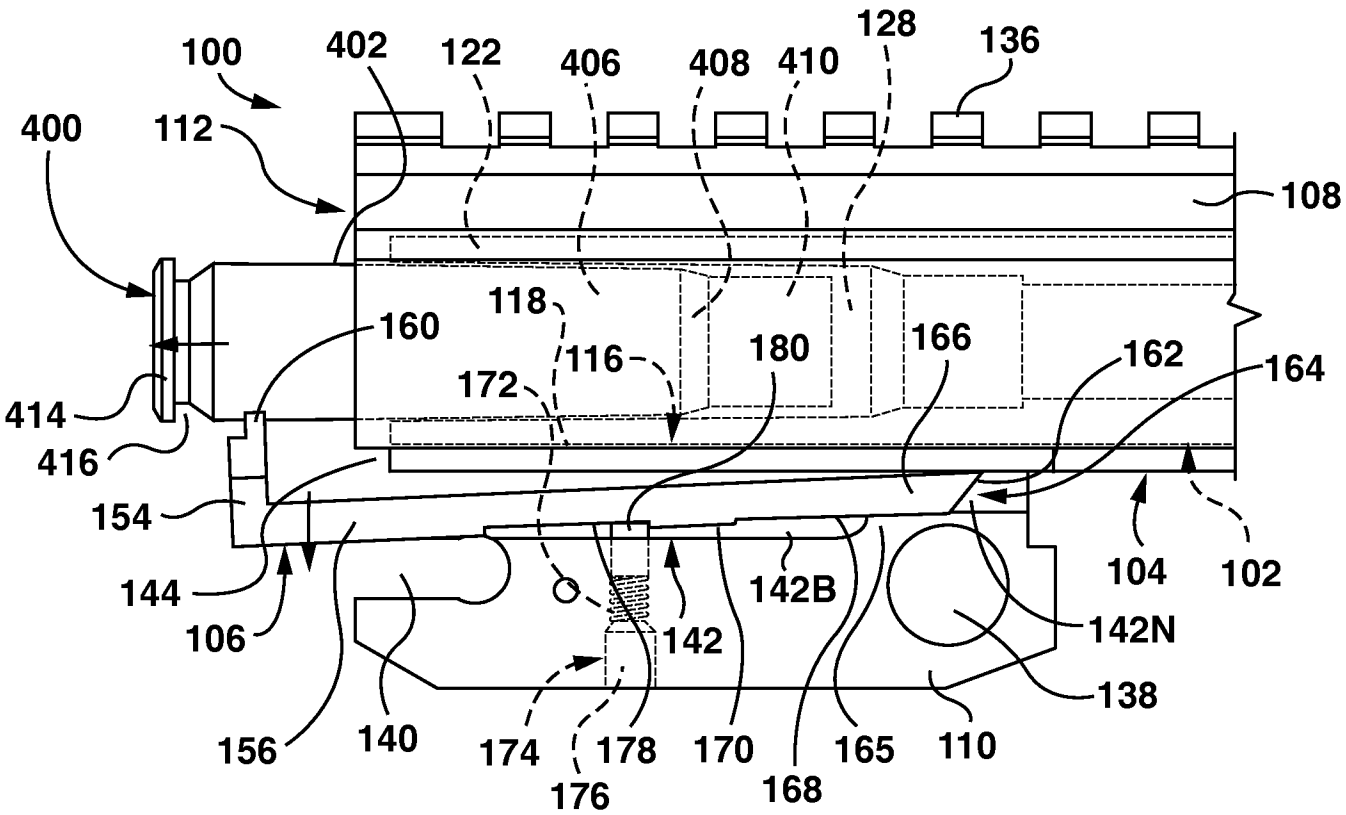

Continuing to pull the cartridge case 402 longitudinally away from the discharge end 114 of the main body 108 will cause the extractor head 154, now clear of the extractor stop 148, to pivot away from the main body 108 so that the cartridge-engaging lip 160 rides out of the extractor groove 416 and onto the body 406 of the cartridge case 402, as shown in FIG. 5D. This permits the cartridge case 402 to be completely withdrawn from the chamber 128. Alternatively, the extractor head 154 can be manually pivoted away from the main body 108 to permit withdrawal of the cartridge case 402 from the chamber 128. In this regard, it should be noted that the extractor head 154 pivot away from the main body 108 in intermediate positions between the firing position and the extended position as long as the extractor head 154 has moved clear of the extractor stop 148 (e.g. see FIG. 4B).

Figure 5E:
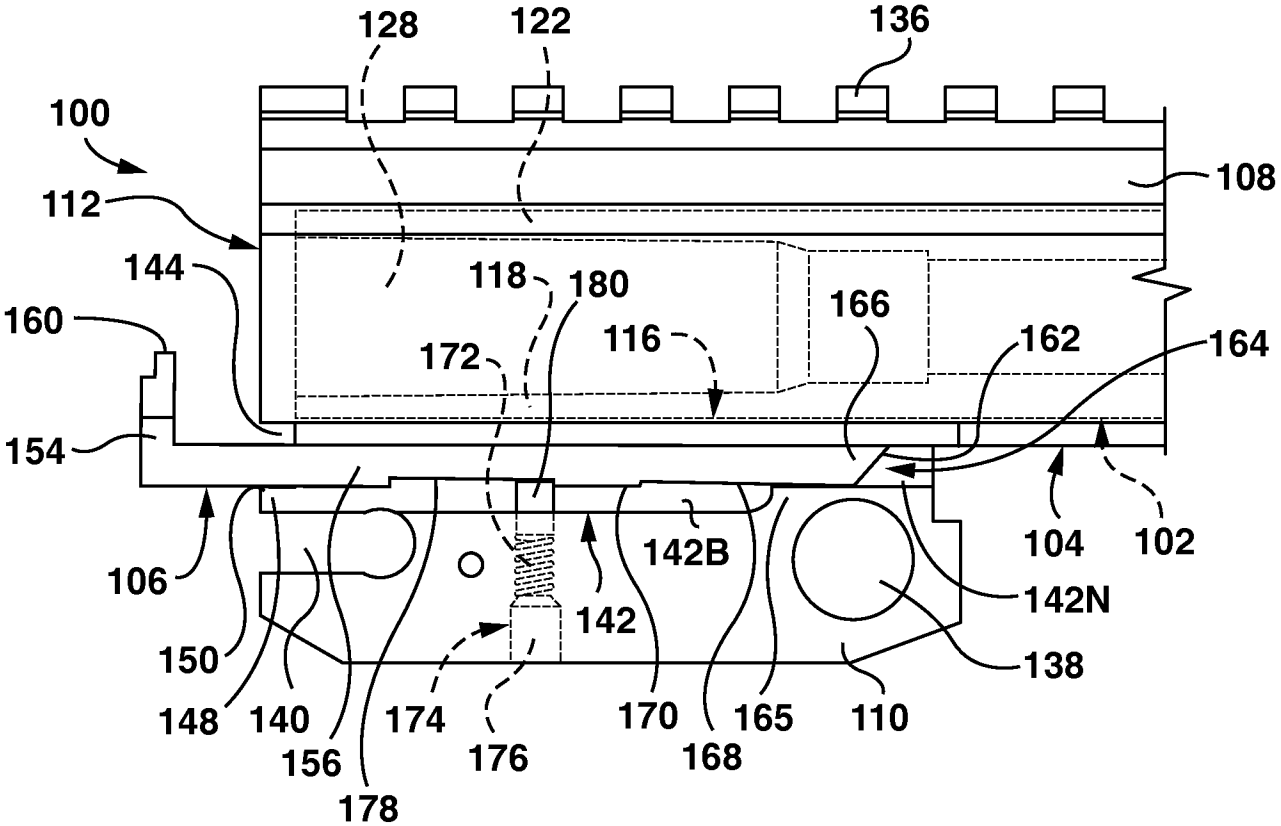

Referring now to FIG. 5E, once the cartridge case 402 has been withdrawn from the chamber 128, the extractor head 154 pivots back toward the main body 108 under urging from the coil springs 172. A new cartridge can then be loaded.

FIGS. 4A to 5E illustrate operation of the exemplary barrel adaptor 100 and barrel 102 during loading, firing and unloading of a rimless cartridge as part of a single-shot break-action firearm. As noted above, a single-shot break-action firearm incorporating the barrel adaptor 100 can be adapted for use with different types and calibers of ammunition by changing the barrel that is releasably interengaged with the barrel adaptor 100 and installing an appropriately dimensioned extractor.

Figure 6:
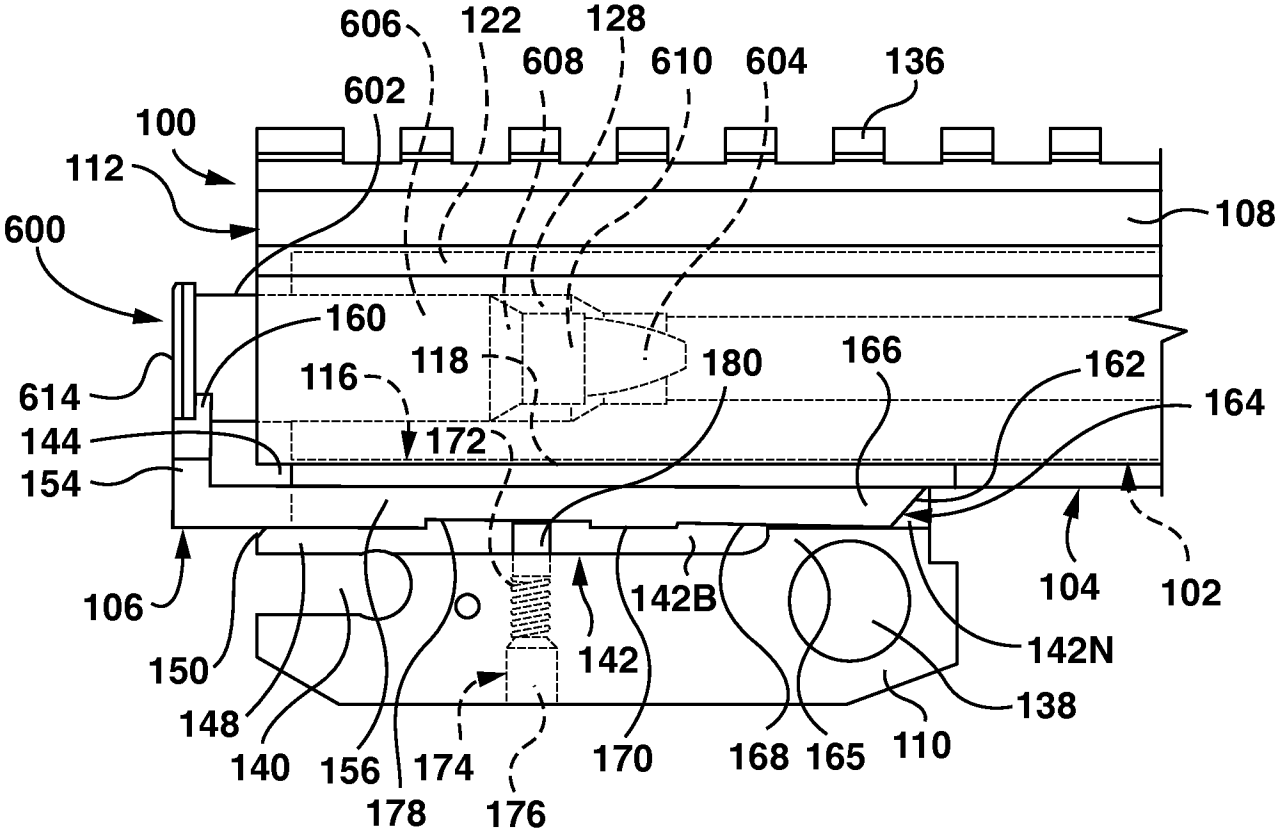
FIG. 6 is a partially transparent side elevation view of a portion of a barrel assembly, showing use thereof with a rimmed cartridge.

FIG. 6 shows the exemplary barrel adaptor 100 chambered for a rimmed cartridge 600, which has been partially inserted in the chamber 128 through the breech end 112 of the main body 108. Like the rimless cartridge 400, the rimmed cartridge 600 comprises a body 606 for containing propellant and which narrows at a shoulder 608 into a neck 610 that receives the bullet 604 (as noted above, in other embodiments the cartridge body may not narrow at a shoulder). However, the rimmed cartridge 600 differs from the rimless cartridge 400 in that the rim 614 extends outwardly from the body 606 of the cartridge case 602, with no extractor groove.

Operation of the exemplary barrel adaptor 100 and barrel 102 during loading, firing and unloading of a rimmed cartridge (e.g. rimmed cartridge 600) is similar to that described above for the exemplary rimless cartridge 400, although with certain differences. One difference is that the shape of the rimmed cartridge 600 makes it unnecessary for the extractor head 154 to pivot away from the main body 108 during insertion of the rimmed cartridge 600 and removal of the cartridge case 602 after the bullet 604 has been fired. In particular, as can be seen in FIG. 6, because the rim 614 extends outwardly from the body 606 of the cartridge case 602, the cartridge-engaging lip 160 can engage the rim 614 while the body 606 of the cartridge case 602 rests in the arcuate recess 158. Accordingly, where a barrel adaptor according to the present disclosure is intended for use solely with rimmed cartridges, the extractor head need not be pivotable relative to the main body. In such an embodiment, the extractor channels and/or extractor may be dimensioned for sliding motion only.

Barrel adaptors according to aspects of the present disclosure may be advantageous in fitting the barrel to adjust the headspace of the firearm. The term "headspace" is well known in the field of firearms, and refers generally to the distance between the breech face and a designated position or feature within the chamber. The headspace value represents an acceptable variation between the minimum ("go") and maximum ("no go") dimension of the appropriate feature. As merely one illustrative example, the designated position or feature may be the allowable clearance for the rim in a chamber for a rimmed cartridge. As is well known in the firearms art, headspace should, for a particular type of cartridge, fall within a particular range, since problems are associated with both insufficient headspace and excessive headspace. Conventionally, headspace is measured using so-called "go gauges" and "no-go gauges" which approximate the shape of the relevant cartridge. A go gauge is dimensioned to represent the minimum safe headspace; if the breech can be fully closed with a go gauge in the chamber then there is sufficient headspace. Conversely, a no-go gauge is dimensioned to represent maximum headspace; so long as the breech cannot be fully closed with a no-go gauge in the chamber then the headspace is not excessive.

One technique for setting headspace on a firearm incorporating a barrel adaptor according to aspects of the present disclosure, suitable for use with rimmed or rimless cartridges, is as follows. With the barrel 102 partially threaded into the barrel adaptor 100, an appropriate go gauge (not shown) is chambered. The firearm 900 is then moved to the breech closed configuration (FIG. 9A), and the barrel 102 is then further threaded into the barrel adaptor 100 until the go gauge contacts the breech face. At this point, the headspace will be at the minimum (as represented by the go gauge), and the barrel 102 can be secured in position using the locknut 132.

Another technique for setting headspace on a firearm incorporating a barrel adaptor according to aspects of the present disclosure takes advantage of the fact that the extractor 106 is dimensioned for the particular ammunition with which it will be used. With a suitably chambered barrel for which the known thickness of the extractor has been factored into the chambering process, the extractor head 154 will position the barrel to achieve the minimum headspace, without the need for a separate go gauge. Thus, with the barrel 102 partially threaded into the barrel adaptor 100 and the firearm 900 in the breech closed configuration (FIG. 9A), the barrel 102 is then further threaded into the barrel adaptor 100 until the extractor head 154 contacts the breech face. The headspace will be at the minimum (as measured by the extractor head 154), and the locknut 132 can then be tightened to secure the barrel 102 in position.

Figure 7:
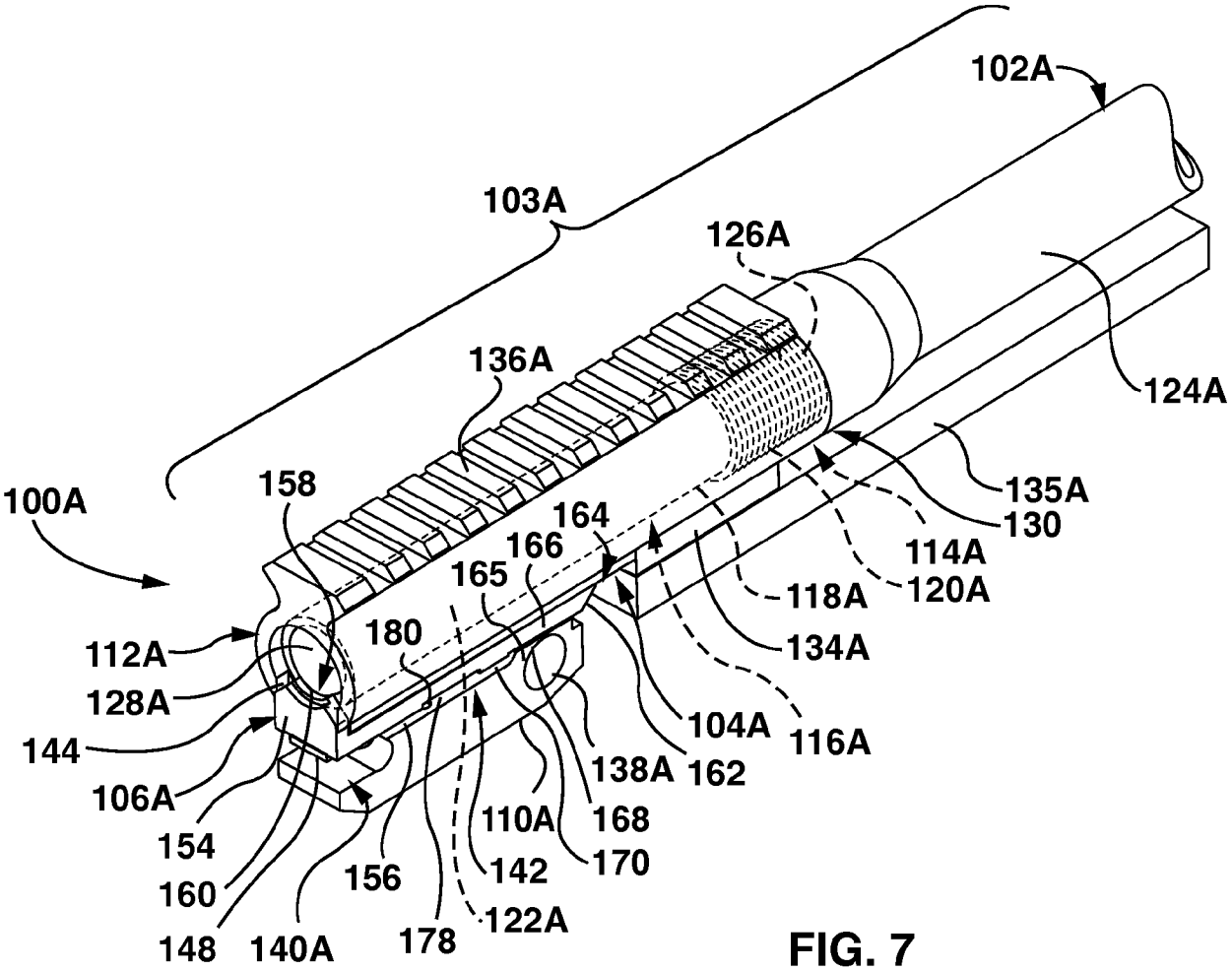
FIG. 7 is a perspective view showing an exemplary barrel adaptor incorporated into a second exemplary barrel assembly for a single-shot break-action firearm.

It is contemplated that in some embodiments, a barrel may be attached to the barrel adaptor without use of a locknut, with the barrel being dimensioned such that appropriate headspace will be present when it is fully threaded into the barrel adaptor. An example of such an arrangement is shown in FIG. 7, with a suitably located shoulder 130 on the barrel tightened against the discharge end 114. The arrangement shown in FIG. 7 is otherwise identical to the arrangement shown in FIGS. 1 to 5E, with like reference numerals referring to like features except with the additional suffix "A". The arrangement shown in FIG. 7 does not provide for the headspace adjustment described above, and therefore is less preferred than the arrangement shown in FIGS. 1 to 5E.

Figure 8:
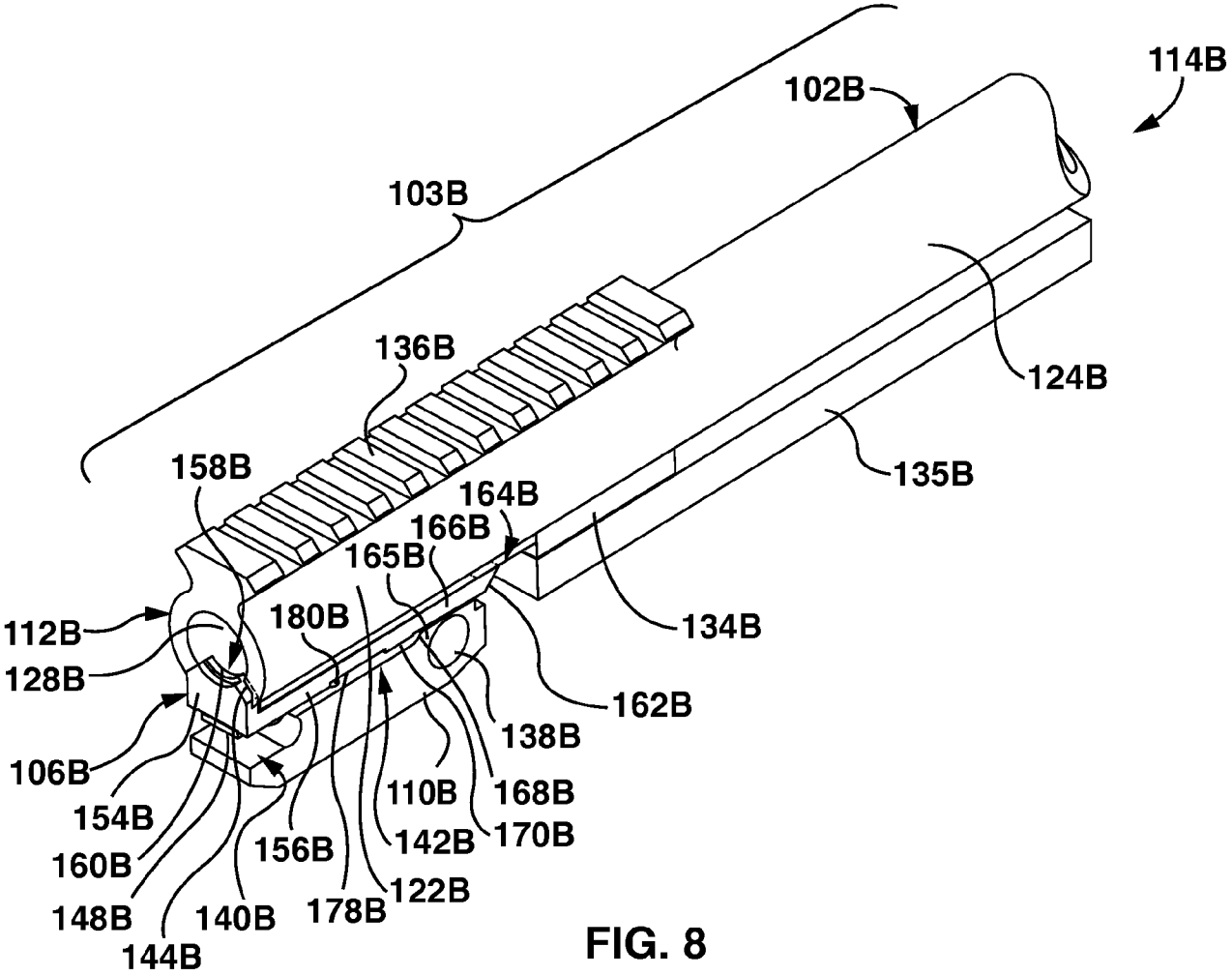
FIG. 8 is a perspective view showing a third exemplary barrel assembly for a single-shot break-action firearm.

It is further contemplated that features associated with the above-described barrel adaptor may be applied to a barrel assembly for a single-shot break-action firearm, such as a Contender-style firearm. An example of such a barrel assembly is shown in FIG. 8, and is indicated generally by reference 103B. The barrel assembly 103B is similar to the barrel assemblies 103, 103A formed by the barrel adaptor 100, 100A and barrel 102, 102A shown in FIGS. 1 to 3 and 7, respectively, with corresponding reference numerals referring to corresponding features except with the additional suffix "B". The barrel assembly 103B differs from the barrel assemblies 103, 103A in that instead of the barrel being threaded into a barrel stub that carries the lug, extractor, fore-end mount and mounting rail, the barrel 102B itself is an integral unit that carries the lug 110B, extractor 106B, fore-end mount 134B and mounting rail 136B. Thus, the barrel 102B has a breech end 112B and a discharge end 114B. A chamber 128B is formed at the breech end 112B and adapted to receive a cartridge, and a bore 116B, co-axial with the chamber 128B, extends through the barrel 102B from the discharge end 114B to the chamber 128B. The lug 110B, adapted for mounting to a single-shot break-action firearm receiver assembly such as a Contender-style receiver assembly, protrudes from the barrel 102B adjacent the breech end 112B thereof, with the crossbore 138B extending through the lug 110B substantially perpendicularly to the bore 116B. A pair of opposed parallel extractor channels 142B is formed in the barrel assembly 103B between the chamber 128B and the locking bolt receptacle 140B; the extractor channels 142B are substantially parallel to the chamber 128B and the bore 116B. An extractor head recess 144B is formed in the barrel 102B at the breech end 112B thereof and extends into the chamber 128B and also extends into the lug 110B to merge with the extractor channels 142B to form an extractor receptacle 146B (see FIG. 2).

Preferably, the barrel 103B is of monolithic construction with the lug 110B, extractor 106B, fore-end mount 134B and mounting rail 136B. Other aspects of the construction and operation of the barrel assembly 103B are similar to those of the barrel assemblies 103, 103A formed by the barrel adaptor 100, 100A and barrel 102, 102A shown in FIGS. 1 to 3 and 7, respectively, and for the avoidance of repetition are not described further. One skilled in the art will appreciate that the barrel assembly 103B does not provide for the headspace adjustment described above.

While the illustrated embodiments are intended to be compatible with Contender-style receiver assemblies, barrel adaptors and barrel assemblies according to the present disclosure can be used with any suitable single-shot break-action firearm which uses a compatible hinge pin and locking bolt arrangement for interchanging barrel assemblies and which provides a suitable cam surface for engaging the inclined cam surfaces 162 at the distal ends 164 of the extractor arms 156 to actuate the extractor 106. For example, in some single-shot break-action firearms, the locking bolt may be located in the receiver.

Certain embodiments have been described by way of example. It will be apparent to persons skilled in the art that a number of variations and modifications can be made without departing from the scope of the claims.

What is claimed is:

1. A barrel adaptor for a single-shot break-action firearm, comprising:

a barrel stub comprising a main body and a lug;

the main body having a breech end and a discharge end and a barrel-receiving bore extending therethrough from the breech end to the discharge end;

the barrel-receiving bore comprising:

an internally threaded portion extending from the discharge end toward the breech end;

the lug protruding from the main body adjacent the breech end;

the lug being adapted for mounting to a single-shot break-action firearm receiver assembly and having:

a crossbore extending through the lug substantially perpendicularly to the barrel-receiving bore and adapted to receive a hinge pin;

the crossbore disposed at a first end of the lug distal from the breech end;

a locking bolt receptacle formed in the lug and adapted to receive a locking bolt and a locking bolt spring;

the locking bolt receptacle disposed at a second end of the lug proximal to the breech end;

wherein:

a pair of opposed parallel extractor channels is formed in the barrel stub between the barrel-receiving bore and the locking bolt receptacle;

the extractor channels being substantially parallel to the barrel-receiving bore;

an extractor head recess is formed in the main body at the breech end thereof and extends into smooth-walled portion of the barrel-receiving bore;

the extractor head recess extending into the lug to merge with the extractor channels to form an extractor receptacle.

2. The barrel adaptor of claim 1, wherein the smooth-walled portion of the barrel-receiving bore extend from the breech end toward the discharge end.

3. The barrel adaptor of claim 2, wherein:

the lug further comprises an extractor stop interposed between the locking bolt receptacle and the extractor receptacle;

the extractor stop being in registration with the extractor head recess.

4. The barrel adaptor of claim 3, wherein the extractor stop has a sloped leading edge on a surface thereof proximal to the extractor head recess.

5. The barrel adaptor of claim 4, further comprising an extractor, wherein:

the extractor comprises:

an extractor head having an arcuate recess including a cartridge-engaging lip adapted to engage a cartridge extraction surface; and a pair of opposed, spaced apart substantially parallel extractor arms extending from a first side of the extractor head;

each extractor arm having an inclined cam surface at a distal end thereof, relative to the extractor head;

the extractor arms being received in the extractor channels whereby the extractor is longitudinally movable between:

a firing configuration in which the extractor head is received in the extractor head recess; and an extended configuration in which the extractor head is withdrawn outwardly from the extractor head recess.

6. The barrel adaptor of claim 5, wherein, at least when the extractor is in the extended configuration:

the extractor arms can pivot within the extractor channels;

so that the extractor head can pivot toward and away from the main body.

7. The barrel adaptor of claim 6, further comprising at least one biasing member acting between the lug and the extractor to urge the extractor head toward the main body.

8. The barrel adaptor of claim 7, wherein:

the at least one biasing member comprises two opposed biasing members;

each biasing member acting between the lug and a respective extractor arm.

9. The barrel adaptor of claim 8, wherein:

each biasing member urges a respective limiter pin into engagement with a respective extractor arm on a surface of the extractor arm facing toward the lug to limit movement of the extractor.

10. The barrel adaptor of claim 9, wherein:

the lug has two opposed biasing bores formed therethrough;

the biasing bores arranged substantially perpendicular to the crossbore and substantially perpendicular to the barrel-receiving bore;

the biasing bores disposed between the crossbore and the extractor head recess;

the biasing members are coil springs;

at least one retaining element is received in the biasing bores at ends thereof remote from the extractor channels;

each of the limiter pins and biasing members being received in a respective biasing bore such that:

each limiter pin is trapped between the respective extractor arm and the respective biasing member; and each biasing member is trapped between the respective limiter pin and the at least one retaining element.

11. The barrel adaptor of claim 2, further comprising:

a fore-end mount protruding from the main body between the lug and the discharge end;

the fore-end mount being spaced from and in registration with the lug.

12. The barrel adaptor of claim 2, further comprising:

a mounting rail on the main body opposite the lug;

the mounting rail and the main body being of monolithic construction.

* * * * *